US011113932B2

(12) United States Patent
Chun et al.

(10) Patent No.: US 11,113,932 B2
(45) Date of Patent: Sep. 7, 2021

(54) ELECTRONIC GAMING MACHINE SUPPORTING TABLE GAMES

(71) Applicant: Fresh Idea Global Limited, Hong Kong (HK)

(72) Inventors: Jay Chun, Hong Kong (HK); Daryn Kiely, Hong Kong (HK)

(73) Assignee: Fresh Idea Global Limited, Hong Kong (HK)

( * ) Notice: Subject to any disclaimer, the term of this patent is extended or adjusted under 35 U.S.C. 154(b) by 0 days.

(21) Appl. No.: 15/666,486

(22) Filed: Aug. 1, 2017

(65) Prior Publication Data

US 2019/0043318 A1 Feb. 7, 2019

(51) Int. Cl.
*G07F 17/34* (2006.01)
*G07F 17/32* (2006.01)

(52) U.S. Cl.
CPC ..... *G07F 17/34* (2013.01); *G07F 17/3209* (2013.01); *G07F 17/3213* (2013.01); *G07F 17/3225* (2013.01); *G07F 17/3246* (2013.01); *G07F 17/3262* (2013.01); *G07F 17/3267* (2013.01); *G07F 17/3288* (2013.01)

(58) Field of Classification Search
CPC .. G07F 17/34; G07F 17/3209; G07F 17/3213; G07F 17/3225; G07F 17/3246; G07F 17/3262; G07F 17/3267; G07F 17/3288; A63F 1/18
See application file for complete search history.

(56) References Cited

U.S. PATENT DOCUMENTS

| | | | |
|---|---|---|---|
| 629,672 | A | 7/1899 | Fadum |
| D72,257 | S | 3/1927 | Haunz |
| 2,302,333 | A | 11/1942 | Linke |
| D141,237 | S | 5/1945 | Gauvreau |
| D150,824 | S | 9/1948 | Buckner |
| D170,040 | S | 7/1953 | Altemiller |

(Continued)

FOREIGN PATENT DOCUMENTS

| | | |
|---|---|---|
| CN | 101244335 | 8/2008 |
| CN | 101513571 | 8/2009 |

(Continued)

OTHER PUBLICATIONS

Office Action for U.S. Appl. No. 13/948,101, dated Dec. 16, 2013.

(Continued)

*Primary Examiner* — Yingchuan Zhang

(57) ABSTRACT

Embodiments disclosed herein concern methods and systems for providing wager-based gaming using an electronic gaming machine that mimics a table game. For example, a table game often makes use of physical objects in carrying out a wager-based game. The same physical objects can be represented in the electronic gaming machine. The physical objects have different potential outcomes when used in the wager-based game. The particular potential outcome yielded by the physical objects can be randomized by a randomizing action. In one embodiment, the physical objects can be implemented by one or more reels contained within the electronic gaming machine, and the reels can include reel-stops that represent the different possibilities that the physical objects can yield during a wager-based game.

29 Claims, 13 Drawing Sheets

(56) References Cited

U.S. PATENT DOCUMENTS

D246,916 S 1/1978 Cheng
D259,847 S 7/1981 Hamby
D268,368 S 3/1983 Moss
D280,477 S 9/1985 Petrick
4,856,787 A 8/1989 Itkis
5,031,913 A 7/1991 Hirosumi
D321,614 S 11/1991 Liptak
5,083,271 A 1/1992 Thacher et al.
5,347,061 A 9/1994 Harandi et al.
5,472,194 A 12/1995 Breeding et al.
5,605,334 A 2/1997 McCrea
5,707,061 A 1/1998 Ikeda et al.
5,762,552 A 6/1998 Vuong
5,768,382 A 6/1998 Schneier et al.
5,823,873 A 10/1998 Moody
5,851,011 A 12/1998 Lott
5,917,725 A 6/1999 Thacher et al.
5,970,143 A 10/1999 Schneier et al.
6,165,069 A 12/2000 Sines et al.
D438,260 S 2/2001 Isetani
D438,404 S 3/2001 Topper
6,331,148 B1 12/2001 Krause
6,361,044 B1 3/2002 Block
6,394,901 B1 5/2002 Marta
6,508,709 B1 1/2003 Karmarkar
6,652,378 B2 11/2003 Cannon
6,671,358 B1 12/2003 Seidman et al.
6,886,829 B2 5/2005 Hessing et al.
6,991,544 B2 1/2006 Soltys et al.
7,008,322 B1 3/2006 Suzuki et al.
7,040,982 B1 5/2006 Jarvis
D539,854 S 4/2007 Luciano
7,206,762 B2 4/2007 Sireau
7,233,922 B2 6/2007 Asher
D546,596 S 7/2007 McDermott
D557,348 S 12/2007 Gutknecht
7,553,233 B2 6/2009 Jarvis et al.
D596,678 S 7/2009 Myers
7,566,268 B2 7/2009 Asher
7,566,270 B2 7/2009 Amaitis
7,604,537 B2 10/2009 Amaitis
7,637,506 B2 12/2009 Naicker
7,684,874 B2 3/2010 Schlottmann et al.
7,690,996 B2 4/2010 Iddings et al.
D615,319 S 5/2010 Tuszkiewicz
7,711,628 B2 5/2010 Davie
7,727,060 B2 6/2010 Mills
7,731,586 B2 6/2010 Letovsky et al.
7,783,542 B2 8/2010 Horowitz
7,783,552 B2 8/2010 Assia
7,798,895 B2 9/2010 Jubinville et al.
D641,427 S 7/2011 Lin
D645,910 S 9/2011 Foster
8,052,526 B2 11/2011 Abbott et al.
8,070,583 B2 12/2011 Baerlocher et al.
8,150,157 B2 4/2012 Downs et al.
8,257,166 B2 9/2012 Kido
8,262,090 B2 9/2012 Soltys et al.
8,272,892 B2 9/2012 McNeely et al.
8,282,489 B2 10/2012 Azerina et al.
8,348,278 B2 1/2013 Tseng
8,444,148 B1 5/2013 Tseng
8,469,788 B2 6/2013 Carpenter et al.
8,590,895 B2 11/2013 Kwon
8,684,830 B1 4/2014 Chun
8,808,077 B1 8/2014 Chun
8,920,229 B1 12/2014 Chun
9,292,996 B2 3/2016 Davis et al.
9,311,773 B2 4/2016 Chung
9,449,461 B1 9/2016 Barksdale
9,592,450 B2 3/2017 Chun
9,595,166 B2 3/2017 Chun
9,649,553 B2 5/2017 Koyanagi
9,779,580 B2 10/2017 Jones
9,858,752 B2 1/2018 Montgomery
9,931,562 B2 4/2018 Chun
9,940,782 B2 4/2018 Chun
RE46,826 E 5/2018 Hill
10,013,847 B2 7/2018 Chun
10,147,269 B2 12/2018 Chun
D852,890 S 7/2019 Ross
10,688,383 B2 6/2020 Chun
2002/0002073 A1 1/2002 Montgomery
2002/0094869 A1 7/2002 Harkham
2002/0147042 A1 10/2002 Shinners et al.
2002/0151366 A1 10/2002 Walker et al.
2003/0070178 A1 4/2003 Boyd
2003/0137110 A1 7/2003 Huard et al.
2003/0195841 A1 10/2003 Ginsberg
2004/0121839 A1 6/2004 Web
2004/0152498 A1 8/2004 Kaminkow
2004/0204232 A1 10/2004 Asher
2005/0043094 A1 2/2005 Nguyen et al.
2005/0116410 A1* 6/2005 Vlazny ..... G07F 17/32 273/139
2005/0165669 A1 7/2005 Montanaro
2005/0197938 A1 9/2005 Davie
2005/0197948 A1 9/2005 Davie
2006/0025221 A1 2/2006 Jain
2006/0058082 A1 3/2006 Crawford et al.
2006/0058083 A1 3/2006 Crawford et al.
2006/0058084 A1 3/2006 Crawford et al.
2006/0058085 A1 3/2006 White et al.
2006/0058086 A1 3/2006 White et al.
2006/0058087 A1 3/2006 White et al.
2006/0058088 A1 3/2006 Crawford et al.
2006/0058089 A1 3/2006 White et al.
2006/0058090 A1 3/2006 Crawford et al.
2006/0058091 A1 3/2006 Crawford et al.
2006/0058092 A1 3/2006 Crawford et al.
2006/0058093 A1 3/2006 White et al.
2006/0066052 A1 3/2006 White et al.
2006/0068498 A1 3/2006 White et al.
2006/0068864 A1 3/2006 White et al.
2006/0068865 A1 3/2006 White et al.
2006/0068866 A1 3/2006 White et al.
2006/0068868 A1 3/2006 Crawford et al.
2006/0068869 A1 3/2006 White et al.
2006/0068870 A1 3/2006 Crawford et al.
2006/0068871 A1 3/2006 Crawford et al.
2006/0068879 A1 3/2006 Crawford et al.
2006/0068899 A1 3/2006 White et al.
2006/0094493 A1 5/2006 Kido
2006/0100019 A1 5/2006 Hornik et al.
2006/0105839 A1 5/2006 Graeve
2006/0217199 A1 9/2006 Adcox et al.
2006/0264252 A1 11/2006 White et al.
2006/0287066 A1 12/2006 Crawford et al.
2006/0287067 A1 12/2006 White et al.
2006/0287097 A1 12/2006 Moshal
2006/0287101 A1 12/2006 Crawford et al.
2006/0287102 A1 12/2006 White et al.
2006/0287103 A1 12/2006 Crawford et al.
2006/0287104 A1 12/2006 White et al.
2007/0015583 A1 1/2007 Tran
2007/0032283 A1 2/2007 Chun
2007/0060259 A1 3/2007 Pececnik
2007/0087832 A1 4/2007 Abbott et al.
2007/0090595 A1 4/2007 Csikos
2007/0129138 A1 6/2007 Amaitis
2007/0178955 A1 8/2007 Mills
2007/0259709 A1 11/2007 Kelly et al.
2008/0045344 A1 2/2008 Schlottmann et al.
2008/0081685 A1 4/2008 Naftaly
2008/0102916 A1 5/2008 Kovacs
2008/0108404 A1 5/2008 Iddings et al.
2008/0108436 A1* 5/2008 Oberberger ..... G07F 17/3293 463/42
2008/0113767 A1 5/2008 Nguyen et al.
2008/0153571 A1 6/2008 Okada
2008/0200242 A1 8/2008 Ginsberg
2008/0220837 A1 9/2008 Yoshizawa
2008/0248849 A1 10/2008 Lutnick et al.
2008/0248864 A1 10/2008 Toyoda

(56) References Cited

U.S. PATENT DOCUMENTS

| | | | | |
|---|---|---|---|---|
| 2008/0318651 | A1 | 12/2008 | Gross | |
| 2009/0005165 | A1 | 1/2009 | Arezina | |
| 2009/0121434 | A1 | 5/2009 | Baerlocher | |
| 2009/0124323 | A1 | 5/2009 | Dunn et al. | |
| 2009/0131151 | A1 | 5/2009 | Harris et al. | |
| 2009/0189351 | A1 | 7/2009 | Baerlocher | |
| 2009/0197676 | A1 | 8/2009 | Baerlocher | |
| 2009/0215529 | A1 | 8/2009 | Inamura | |
| 2009/0275376 | A1 | 11/2009 | Anderson | |
| 2009/0280904 | A1 | 11/2009 | Nicely et al. | |
| 2009/0291762 | A1 | 11/2009 | Walter | |
| 2009/0325686 | A1 | 12/2009 | Davis et al. | |
| 2010/0087241 | A1 | 4/2010 | Nguyen et al. | |
| 2010/0150460 | A1 | 4/2010 | Makhoul et al. | |
| 2010/0234089 | A1* | 9/2010 | Saffari | G07F 17/34 463/20 |
| 2010/0234099 | A1 | 9/2010 | Rasmussen | |
| 2010/0331085 | A1 | 12/2010 | Nagano | |
| 2011/0018194 | A1 | 1/2011 | Nicely et al. | |
| 2011/0111833 | A1 | 5/2011 | Nordahl | |
| 2011/0294561 | A1 | 12/2011 | Shaw et al. | |
| 2011/0300917 | A1 | 12/2011 | Hill | |
| 2012/0049447 | A1 | 3/2012 | Klein | |
| 2012/0049455 | A1 | 3/2012 | Yap et al. | |
| 2012/0083909 | A1 | 4/2012 | Carpenter et al. | |
| 2012/0122564 | A1 | 5/2012 | Kovacs | |
| 2012/0214575 | A1 | 8/2012 | Amaitis et al. | |
| 2012/0252564 | A1 | 10/2012 | Moore et al. | |
| 2012/0264496 | A1 | 10/2012 | Behrman | |
| 2012/0329551 | A1 | 12/2012 | Arerina et al. | |
| 2013/0005456 | A1 | 1/2013 | Okujo et al. | |
| 2013/0079147 | A1 | 3/2013 | Merati | |
| 2013/0116031 | A1 | 5/2013 | Carpenter et al. | |
| 2013/0134672 | A1 | 5/2013 | Okuaki | |
| 2013/0225276 | A1 | 8/2013 | Au-Yeung | |
| 2013/0244765 | A1 | 9/2013 | Arnone et al. | |
| 2013/0260863 | A1 | 10/2013 | Lee | |
| 2013/0281197 | A1 | 10/2013 | Carpenter et al. | |
| 2013/0288764 | A1 | 10/2013 | Chun | |
| 2013/0288779 | A1 | 10/2013 | Chun | |
| 2013/0296031 | A1 | 11/2013 | Arnone et al. | |
| 2013/0341862 | A1 | 12/2013 | Tokue | |
| 2014/0094256 | A1 | 4/2014 | Hilbert | |
| 2014/0094298 | A1 | 4/2014 | Lyons | |
| 2014/0162758 | A1* | 6/2014 | Pececnik | G07F 17/3288 463/22 |
| 2014/0187306 | A1 | 7/2014 | Nordahl | |
| 2014/0256392 | A1 | 9/2014 | Jones | |
| 2014/0256411 | A1* | 9/2014 | Basallo | G07F 17/3267 463/25 |
| 2014/0274252 | A1 | 9/2014 | Chun | |
| 2014/0274253 | A1 | 9/2014 | Chun | |
| 2014/0312567 | A1 | 10/2014 | Chun | |
| 2015/0019744 | A1 | 1/2015 | Bourenkov | |
| 2015/0024818 | A1 | 1/2015 | Chun | |
| 2015/0116410 | A1 | 4/2015 | Armbruster et al. | |
| 2015/0161851 | A1 | 6/2015 | Naicker | |
| 2015/0332552 | A1 | 11/2015 | Chun | |
| 2016/0292954 | A1 | 10/2016 | Sugai et al. | |
| 2017/0161988 | A1 | 6/2017 | Nguyen | |
| 2017/0161993 | A1 | 6/2017 | Nguyen | |
| 2018/0315272 | A1 | 11/2018 | Chun | |

FOREIGN PATENT DOCUMENTS

| | | | |
|---|---|---|---|
| CN | 102580306 | | 7/2012 |
| EP | 1939826 | A2 | 7/2008 |
| TW | 201138907 | A1 | 11/2011 |

OTHER PUBLICATIONS

Cantor Fitzgerald Hopes to Bring Spread Betting to Las Vegas Casinos, Dec. 14, 2009.
Financial Spread Betting, Apr. 26, 2012.
High-Speed Traders Set Their Sights on Asia and Latin America, Aug. 12, 2010.
Office Action for U.S. Appl. No. 13/456,110, dated Jun. 11, 2013.
Final Office Action for U.S. Appl. No. 13/456,110, dated Dec. 24, 2013.
Office Action for U.S. Appl. No. 14/017,071, dated Nov. 7, 2013.
Notice of Allowance for U.S. Appl. No. 14/017,071, dated Jan. 24, 2014.
Office Action for U.S. Appl. No. 14/017,073, dated Dec. 10, 2013.
Final Office Action for U.S. Appl. No. 13/948,101, dated Apr. 23, 2014.
Notice of Allowance for U.S. Appl. No. 14/017,073, dated May 20, 2014.
Office Action for U.S. Appl. No. 14/095,882, dated Aug. 14, 2014.
Office Action for U.S. Appl. No. 13/456,110, dated Sep. 12, 2014.
Office Action for U.S. Appl. No. 13/542,446, dated Sep. 10, 2014.
Office Action for U.S. Appl. No. 14/197,683, dated Aug. 4, 2014.
Office Action for U.S. Appl. No. 14/174,701, dated Mar. 12, 2015.
Final Office Action for U.S. Appl. No. 13/542,446, dated Mar. 25, 2015.
Final Office Action for U.S. Appl. No. 13/456,110, dated Apr. 22, 2015.
Office Action for U.S. Appl. No. 13/456,110, dated Jan. 13, 2016.
Final Office Action for U.S. Appl. No. 13/542,446, dated Jan. 4, 2016.
Office Action for U.S. Appl. No. 15/094,827, dated Sep. 22, 2016.
Notice of Allowance for U.S. Appl. No. 13/456,110, dated Nov. 16, 2016.
Notice of Allowance for U.S. Appl. No. 13/542,446, dated Nov. 16, 2016.
Office Action for U.S. Appl. No. 14/692,623, dated Oct. 5, 2016.
Office Action for U.S. Appl. No. 14/318,426, dated Sep. 11, 2015.
Notice of Allowance for U.S. Appl. No. 14/318,426, dated Dec. 8, 2015.
Office Action for U.S. Appl. No. 14/508,922, dated Jan. 30, 2017.
Final Office Action for U.S. Appl. No. 14/692,623, dated Mar. 24, 2017.
Notice of Allowance for U.S. Appl. No. 14/692,623, dated Jun. 30, 2017.
Restriction Requirement for U.S. Appl. No. 14/692,623, dated Sep. 6, 2016.
Office Action for U.S. Appl. No. 15/094,827, dated Sep. 13, 2017.
SIPO of People's Republic of China, Examiner's Report and International Search Report for Macau Patent Application No. I-1385 dated May 26, 2017(with partial Translation).
Notice of Allowance for U.S. Appl. No. 14/692,623, dated Nov. 29, 2017.
Final Office Action for U.S. Appl. No. 15/441,182, dated Mar. 16, 2018.
Notice of Allowance for U.S. Appl. No. 15/094,827, dated Apr. 4, 2018.
Notice of Allowance for U.S. Appl. No. 15/691,738, dated May 23, 2018.
Office Action for U.S. Appl. No. 14/929,240, dated Jun. 1, 2018.
Office Action for U.S. Appl. No. 15/231,693, dated Jun. 22, 2018.
Office Action for U.S. Appl. No. 15/943,661, dated Jun. 29, 2018.
Office Action for U.S. Appl. No. 15/666,486 dated Jul. 27, 2018.
Office Action for U.S. Appl. No. 14/508,922, dated Aug. 31, 2018.
Office Action for U.S. Appl. No. 15/441,184, dated Jul. 3, 2018.
Final Office Action for U.S. Appl. No. 14/929,240, dated Dec. 12, 2018.
Final Office Action for U.S. Appl. No. 15/666,486, dated Dec. 31, 2018.
Office Action for U.S. Appl. No. 14/929,240, dated Apr. 5, 2019.
Final Office Action for U.S. Appl. No. 14/508,922, dated May 2, 2019.
Office Action for U.S. Appl. No. 15/666,486, dated Jun. 5, 2019.
Office Action for U.S. Appl. No. 16/167,455, dated Jun. 14, 2019.
Notice of Allowance for U.S. Appl. No. 16/025,994, dated Jun. 26, 2019.
Notice of Allowance for U.S. Appl. No. 14/929,240, dated Sep. 4, 2019.

(56) References Cited

OTHER PUBLICATIONS

Office Action for U.S. Appl. No. 29/667,500, dated Sep. 11, 2019.
Final Office Action for U.S. Appl. No. 15/666,486, dated Nov. 27, 2019.
Final Office Action for U.S. Appl. No. 14/508,922, dated Dec. 6, 2019.
Advisory Action for U.S. Appl. No. 15/666,486, dated Mar. 17, 2020.
Office Action for U.S. Appl. No. 16/877,232, dated Nov. 27, 2020.
Final Office Action for U.S. Appl. No. 16/735,685, dated Jan. 12, 2021.

* cited by examiner

ELECTRONIC GAMING MACHINE SUPPORTING TABLE GAMES

CROSS REFERENCE TO RELATED APPLICATION

This application is related to U.S. patent application Ser. No. 14/508,922, filed Oct. 7, 2014, and entitled "INDIVIDUALIZED INTERACTIVE TABLE GAMING MACHINE," which is incorporated herein for all purposes.

BACKGROUND OF THE INVENTION

Today, gaming establishments, such as casinos, operate gaming apparatus, such as gaming tables that provide casino table games. Casino table games, such as Poker, Roulette, Black Jack, Craps, SicBo, Baccarat, etc., often involve players sitting at a physical table using physical game objects (cards, dice, chips, etc.) to play the games.

These gaming tables are typically administered by human dealers and are played on physical gaming tables having a dealer surface for supporting the game objects, such as cards, dice, chips and the like. Alternatively, such table games can be played in connection with electronic gaming machines where the dealer, playing cards, chips or other gaming elements are physically administered separately from such machines. Other wagering games can also be played entirely on electronic gaming machines. For example, such electronic gaming machines include slot machines as well as video poker, video keno, video blackjack, and the like. Many players like the anonymity and individualized nature of playing such machines alone or away from the crowds that are often attracted to convention physical table games.

While gaming machines, gaming tables, and systems therefor have worked well in practice over many years, there is always a desire for improvement. In particular, there is a need for improved electronic gaming machines that are able to provide table game elements to players who might prefer to play at an individual electronic gaming machine

SUMMARY

Embodiments disclosed herein concern methods and systems for providing wager-based gaming using an electronic gaming machine that mimics a table game. For example, a table game often makes use of physical objects in carrying out a wager-based game. The same physical objects can be represented in the electronic gaming machine. The physical objects are used in the wager-based game to provide different potential outcomes. The particular potential outcome yielded by the physical objects can be randomized by a randomizing action.

In one embodiment, the physical objects often used in table games can be implemented by one or more reels contained within an electronic gaming machine, and the reels can include reel-stops. Each reel-stop can be associated with a game symbol displayed in a reel-stop position, and thus each reel-stop can represent the different possibilities that the physical objects can yield during a wager-based game. In this embodiment, the randomizing action can be a physical reel spin or an electronic randomization (e.g., Random Number Generator (RNG)) of a physical reel-stop position. The outcome of the randomized reel-stops and their associated symbols can be mapped to predetermined payout tables. The reels can be implemented physically (e.g., electro-mechanical reels) or virtually (e.g., animated computer graphics).

The invention can be implemented in numerous ways, including as a method, system, device, apparatus (including computer readable medium and graphical user interface). Several embodiments of the invention are discussed below.

As an electronic gaming machine, one embodiment can, for example, include at least a processor and a data storage device. The processor can be configured to execute a plurality of instructions to provide a wager-based primary game for a player of the wager-based primary game at the electronic gaming machine. The data storage device can be operatively connected to the processor, and the data storage device can store the plurality of instructions. The plurality of instructions can include at least: computer program instructions for configuring the electronic gaming machine to provide primary game operation for the wager-based primary game; computer program instructions for receiving a player input pertaining to a selected wager; computer program instructions for initiating randomized action of game objects as configured for the primary game operation for the wager-based primary game; computer program instructions for determining a primary game outcome for the wager-based primary game and ceasing the randomized action of the game objects based on the primary game outcome; and computer program instructions for determining primary game payout for the player of the wager-based primary game. Additionally, the electronic gaming machine can include a touch screen operatively connected to the processor. The touch screen can be configured to display a plurality of player-selectable bet options and configured to receive one or more selections of the player-selectable bet options.

As an electronic gaming machine, one embodiment can, for example, include at least a processor and a plurality of electro-mechanical reels. The processor can be configured to execute a plurality of instructions to provide a wager-based primary game for a player of the wager-based primary game at the electronic gaming machine. Each of the plurality of electro-mechanical reels can have a plurality of reel-stop positions, and the electro-mechanical reels can be configured to rotate, with rotation of the electro-mechanical reels being controlled based on the processor. The data storage device can be operatively connected to the processor, and can store the plurality of instructions. The plurality of instructions can include at least: computer program instructions for configuring the electronic gaming machine to provide primary game operation for the wager-based primary game; computer program instructions for receiving a player input pertaining to a selected wager; computer program instructions for initiating randomized action of game objects as configured for the primary game operation for the wager-based primary game, the game objects are symbols provided on the reel stop positions, and the randomized action of the game objects comprises spinning the electro-mechanical reels; computer program instructions for determining a primary game outcome for the wager-based primary game and ceasing the randomized action of the game objects based on the primary game outcome, the ceasing of the randomized action of the game objects comprises stopping the spinning of the electro-mechanical reels at the reel stop positions corresponding to the primary game outcome; and computer program instructions for determining primary game payout for the player of the wager-based primary game.

As a wager-based gaming machine, one embodiment can, for example, include at least: (a) one or more input components configured to accept user input from a player regarding play of a wager-based game, wherein the wager-based game includes game rules that at least partially replicate a table game involving physical gaming components; (b) a display configured to present multiple wagering options to the player, wherein each wagering option includes a monetary award that is relative to a probability that a particular game outcome occurs for the wager-based game, wherein the display also concurrently presents a visual pay table in association with the multiple wagering options; (c) a plurality of gaming reels adapted to rotate and stop in response to the player input to provide a game outcome, each of the gaming reels having multiple reel stops, wherein each of the gaming reels serves to implement one of the physical gaming components for the table game being at least partially replicated; and (d) a processor coupled to the one or more input components, the display, and the gaming reels, the processor adapted to facilitate the play of the wager-based game, wherein the wager-based game includes a main game phase and a bonus game phase, wherein the gaming reels are configured or operate to provide reel stop probabilities for the corresponding reel stops, and wherein at least one of the reel stop probabilities for the main game phase is different than at least one of the reel stop probabilities for the bonus game phase.

As a method for providing a wager-based game on an electronic gaming machine, one embodiment can, for example, include at least: configuring the electronic gaming machine to provide primary game operation for the wager-based game; receiving a player input pertaining to a selected wager with its corresponding payout; initiating randomized action of game objects as configured for the game operation for the wager-based game, the game objects are symbols provided on stop positions, and the randomized action of the game objects comprises movement of the game objects; ceasing the movement of the game objects following the randomized action of the game objects and determining a game outcome for the wager-based game, the ceasing of the randomized action of the game objects comprises stopping the movement of the game objects at the stop positions corresponding to the game outcome; and determining a game payout for the player of the wager-based primary game.

As a wager-based gaming machine, one embodiment can, for example, include at least: (a) a plurality of input components configured to accept user input from a player regarding play of a wager-based game, the wager-based game including game rules that at least partially replicate a table wager game that uses at least one die; (b) a display configured to present multiple wagering options to the player, wherein each wagering option replicates wagering options that at least partially replicate wagering options from the table wager game, and wherein each wagering option includes a monetary award based on monetary award rules that at least partially replicate monetary award rules from the table wager game; (c) a plurality of gaming reels, at least one of the plurality of gaming reels configured to represent at least one die, wherein each face of the at least die is displayed on an outer surface of the at least one of the plurality of gaming reels, and each of the plurality of gaming reels having multiple reel stops; and (d) a processor coupled to the one or more input components, the display, and the gaming reels, the processor adapted to facilitate the play of the wager-based game, wherein the wager-based game includes a main game phase and a bonus game phase, wherein the gaming reels are configured or operate to provide reel stop probabilities for the corresponding reel stops.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like elements, and in which.

DETAILED DESCRIPTION OF CERTAIN EMBODIMENTS

Embodiments disclosed herein concern methods and systems for providing wager-based gaming using an electronic gaming machine that mimics a table game. For example, a table game often makes use of physical objects in carrying out a wager-based game (or chance-based game). The same physical objects can be represented in the electronic gaming machine. The physical objects have different potential outcomes when used in the wager-based game. The particular potential outcome yielded by the physical objects can be randomized by a randomizing action.

In one embodiment, the physical objects can be implemented by one or more reels contained within the electronic gaming machine, and the reels can include reel-stops that represent the different possibilities that the physical objects can yield during a wager-based game. In this embodiment, the randomizing action can be a physical reel spin or an electronic randomization (e.g., RNG). Probabilities for the distinct reel-stop positions and their associated symbols can be controlled so as to coincide with predetermined payout tables. The reels can be implemented physically (e.g., mechanically, electro-mechanical reels, and the like) or virtually (e.g., animated computer graphics, digital reels, and the like).

Embodiments of various aspects of the invention are discussed below with reference to FIGS. 1-11. However, those skilled in the art will readily appreciate that the detailed description given herein with respect to these figures is for explanatory purposes as the invention extends beyond these limited embodiments.

Various embodiments to devices, systems and methods for providing, conducting and facilitating play of wagering games (or chance games) at personalized or individualized interactive electronic table gaming machines. Such gaming machines or devices mimic use of live physical table game components in a self-contained and individualized manner, while using mechanical or computerized representations for such physical table game components (e.g., dice, cards, balls, wheels, and the like). As such, this disclosure may be applied to the individualized machine implementation of any live table game, such as Baccarat, Blackjack, Roulette, Craps, Pai Gow, SicBo, Poker, Bingo, Keno, card games, and the like, as well as any other type of table game having physical components that result in game outcomes. The various embodiments disclosed herein can be applied with respect to individual gaming machines, entire systems involving multiple gaming machines, and methods of operating or tracking games on such machines and systems.

Figure 1:
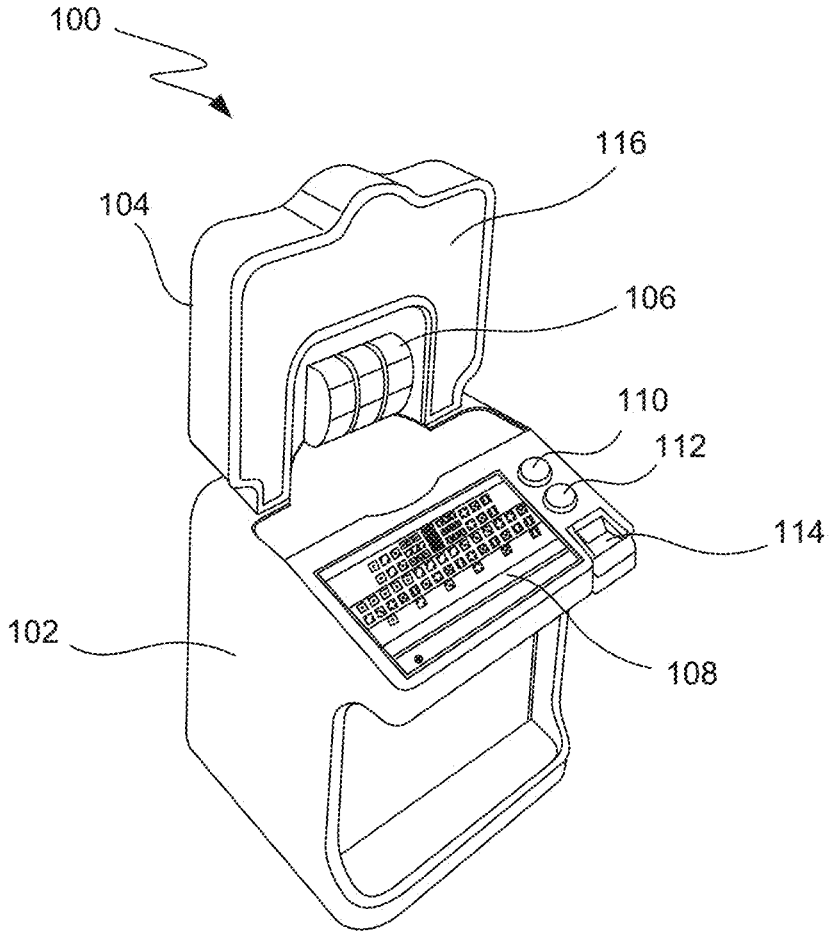
FIG. 1 is a perspective view of an electronic gaming machine supporting a table type game according to one embodiment.

FIG. 1 is a perspective view of an electronic gaming machine 100 supporting a table type game according to one embodiment. The electronic gaming machine 100 can include a base portion 102 and a top portion 104. The electronic gaming machine 100 can also include a randomizing component 106. The base portion 102 can include a visual display 108, which can include a touch screen and/or other player input and output devices. One or more player (or user) inputs, such as buttons 110, 112, can be used for a variety of player input functions, such as to facilitate activation of the randomizing component 106. Alternatively, the player inputs can be provided using other devices, e.g., joystick, mouse, track ball, touch pad, and the like. An acceptor 114 for bills, tickets or vouchers can also be provided at the base portion 102 to accept and provide player credit for game play at the electronic gaming machine 100. Other items not shown may also be included, as will be readily appreciated, with such items including, for example, a player card reader, player tracking device, camera, additional displays, lights, additional inputs (e.g., trackball, mouse), speakers, seats, and the like.

The top portion 104 can include a top visual display 116, which may or may not be game or theme related. One or more additional items may also be included on top portion 104, such as a top glass, bezel, speaker, candle light, additional displays, input or output components, or the like. Also, various items that might be located on base portion 102 may instead be included on the top portion 104, and vice versa.

The randomizing component 106 provides a randomness to one or more game objects that are use with a wager-based game being performed by the electronic gaming machine 100. The game objects can represent any game objects or objects as might be found on a live gaming table, including for example, dice, cards, balls, wheels, and the like, which may be presented alone or in any combination. The randomizing component 106 can include means to randomize results associated with the game objects. The game objects can be used to provide a substantially random outcome that yields game input(s) to the wager-based game, which can then yield a game result for a player of the electronic gaming machine 100.

In one embodiment, the randomizing component 106 can pertain to a reel arrangement in which one or more reels thereof have reel stop positions corresponding to at least the potential values associated with the game objects. For example, if the game objects consist of three dice, then at least a portion of the reel-stop positions on each of three reels can pertains to the potential values for the corresponding die. Although dice can serve as the game objects, it will be readily appreciated that other game objects could be used as well.

Variations in the amount of randomizing action (e.g., spinning, turning, or any other randomized action) of the game objects can be impacted by one or more player inputs provided via the electronic gaming machine 100. For example, variations in characteristics (e.g., rate or duration) of the randomizing action can be impacted by player inputs via one or more of the buttons 110, 112, touch screen, or any other player input device. The manner in which the player interacts with the buttons 110, 112 can also impact the characteristics of the randomizing action. For example, a hard push or pounding of button 110 might result in stronger spinning action of a reel, while a soft push of the button 110 might result in a gentle spinning action of the reel. As another example, the alternative use of the button 112 might result in a randomizing action or effect on the game objects that is different than the randomizing action activated by the button 110. Alternatively, or in addition, the use of both buttons 110 and 112 might result in still other randomizing action or effects to the actuation of the game objects. Also, or in addition, the timing of the press of the button 110, 112 might affect the timing of one or more physical activations that provide a new game object outcome. Such timings may affect when the physical actuation starts, when it stops, and/or its duration, for example. Such timings might also coincide with other visual or audio outcomes or cues provided by the electronic gaming machine 100, such as on the visual display 108 or elsewhere.

Other types of player input components could also be used, with similar and/or additional effects to the physical game components. Such other player activation components could include, for example, plungers, touch screens adapted to accept various touches, swipes or the like, wheels, reels, motion or gesture reading sensors, voice recognition devices, and the like. For example, a motion sensor might be adapted to help the device or system recognize a hard shake player activation based upon a rapid or fast motion or gesture by a player, and/or to recognize a soft shake player activation based upon a gentle or slow motion or gesture by the player. Alternatively, and/or in addition, a microphone and voice recognition device might be adapted to help the device or system recognize various voice commands, as well as volume levels.

In various embodiments, the base portion 102 can be removable from and interchangeable with top portion 104 and other similar top portions, and vice versa. Similarly, top portion 104 can be removable from and interchangeable with bottom portion 102 and other similar bottom portions. Under any such arrangement, randomizing component 106 may also comprise a separate item that goes with or is removable from and/or interchangeable with the bottom portion 102, the top portion 104, or both. In some embodiments, the randomizing component 106 can be modular from the remainder of the electronic gaming machine 100, such that different physical randomizing components can be swapped in and out of the electronic gaming machine 100 as may be desired.

In various embodiments, one or more cameras (not shown), sensors, or other detection devices can be used to detect the actual outcomes on the one or more game objects. Sensors could include, for example, cameras, RFID readers, magnetic readers or detectors, barcode readers or the like, pressure sensors, motion detectors, among other possible sensors. Such a camera(s) and/or other sensors can be located about the top portion 104, at or within the randomizing component 106, and/or at other locations at or along the electronic gaming machine 100 (e.g., bottom portion 102), as may be appropriate. In some embodiments, these cameras and/or other sensors can remain with the base portion 102 while a given randomizing component 106 is interchanged or swapped out for another one. Replaceable sensor components and/or other randomizing component items can add to the varieties of user selection and preferences for the electronic gaming machine 100.

It will be readily appreciated that the electronic gaming machine 100 can be provided in numerous other configurations and formats, such that the provided example is for illustrative purposes only. In various embodiments, the electronic gaming machine 100 can be designed or configured similar to a standard "slot machine," such that only one actual player sits at or otherwise occupies the machine, and is the only player that is permitted to make wagers and plays on the game outcomes at the device. Of course, other people may watch or comment as the one player plays at the electronic gaming machine 100 designed for individualized play. In some embodiments, other players might be allowed to make wagers on the game outcomes, such as where remote monitoring and play is permitted across a system of electronic gaming machines.

Figure 2:
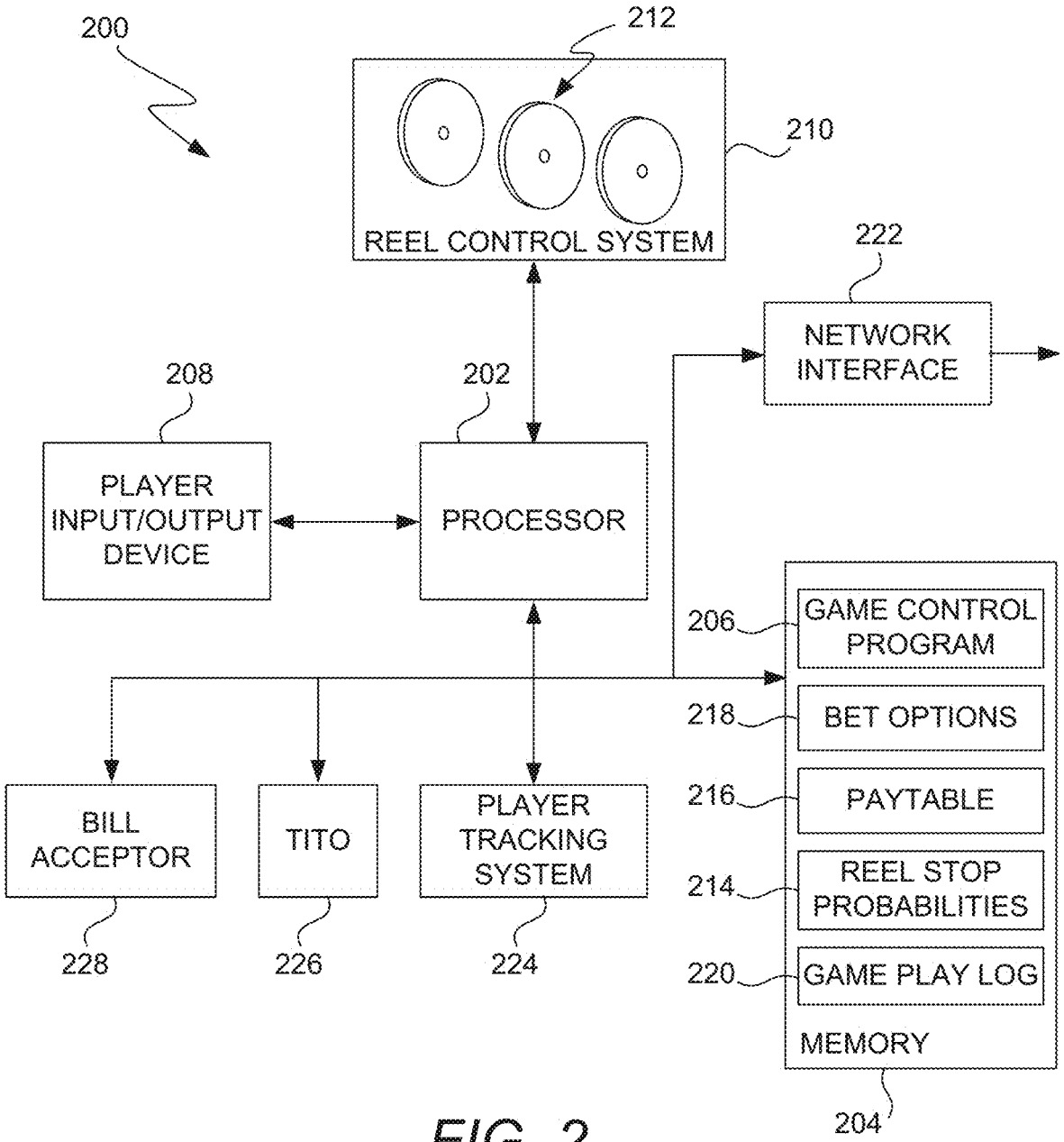
FIG. 2 is a block diagram of a block diagram of an electronic gaming machine according to one embodiment.

FIG. 2 is a block diagram of an electronic gaming machine 200 according to one embodiment. The electronic gaming machine 200 can, for example, pertain to the electronic gaming machine 100 illustrated in FIG. 1. The electronic gaming machine 200 can include a processor 202 that controls operation of the electronic gaming machine 200. The processor 202 can be coupled to a memory 204 that stores a game control program 206. The game control program 206 when executed by the processor 202 provides a wager-based game on the electronic gaming machine 200. The wager-based game can pertain to a primary game and/or a bonus game. The electronic gaming machine 200 can also receive user input and/or provide user output via a player input/output device 208. The player input/output device 208 can pertain to one or more of a button, display, touch screen, and the like as described above.

The electronic gaming machine 200 also includes a reel control system 210 that controls operation of one or more reels 212. The reels 212 are configured to be rotated (e.g., spun) in a controlled manner. The reel control system 210 is in turn controlled by the processor 212 which is instructed by the game control program 206. The reels 212 can be physical reels that are electro-mechanically controlled by the reel control system 210, or the reels 212 can be virtually presented on a display device. The reels 212 can be configured in accordance with reel stop probabilities 214, which can be stored in the memory 204. In one embodiment, the reel stop positions have corresponding reel stop probabilities that may be predetermined or dynamically generated as needed using a RNG. In another embodiment, the reel stop positions have corresponding reel stop probabilities may be pregenerated, such as using a RNG. The reel stop probabilities 214 may also be used to control payout from the wager-based game based on the pay table 216 and bet options 218.

The memory 204 can also store a pay table 216 and bet options 218. The pay table 216 can be presented to a player, such as on a display or touch screen, by the player input/output device 208. In one implementation, the pay table 216 can be provided to the player when the player input/output device 208 is engaged. The bet options 218 can store an indication of the one or more wagers or bets the player has invoked for the wager-based game, such as for example based on input received by the player input/output device 208 and/or the bill acceptor 228. Still further, the memory 204 can also store a game log 220 of all game information pertaining to the play of the wager-based game. The game log 220 is advantageous for accounting reconciliation, regulation audits, and any other desired gaming functions.

The electronic gaming machine 200 also includes a network interface 222 to couple to one or more wired or wireless networks. The electronic gaming machine 200 can, for example, communicate with a server computer, such as a gaming management server of a gaming establishment. In one embodiment, the server computer can interact with the electronic gaming machine 200 to provide the wager-based game. In another embodiment, the electronic gaming machine 200 can assist the server computer (or vice versa) in providing the wager-based game or with any other gaming functions.

In addition, the electronic gaming machine 200 can also include one or more peripheral devices. As shown in FIG. 2, the electronic gaming machine 200 can include a player tracking system 224, a Ticket-In-Ticket-Out (TITO) system 226, and a bill acceptor 228. Although illustrated with a few peripheral devices, this is not intended to be limiting as the electronic gaming machine 200 may have any number of peripheral devices.

Additionally, in some embodiments, the electronic gaming device 200 can include a RNG for use in determining results of a gaming object(s). For example, in an embodiment using virtual reels, the virtual reels are rotated and a resultant reel stop value is controlled by the processor 202 using the reel stop probabilities 414 and the game control program 206. In such an embodiment, the result reel stop value can be determined in a randomized manner, such as using the RNG.

Figure 3:
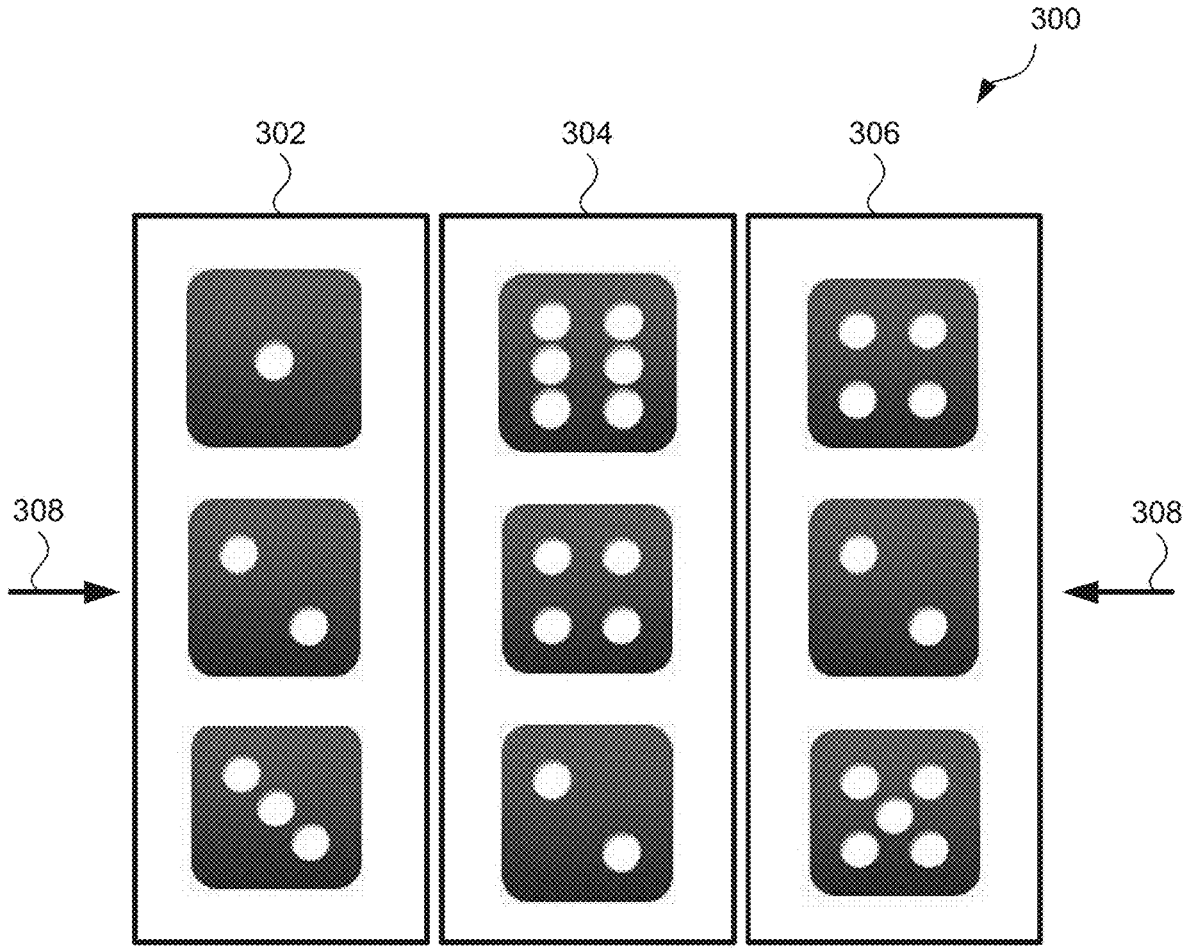
FIG. 3 is a representative diagram of a reel arrangement according to one embodiment.

FIG. 3 is a representative diagram of a reel arrangement 300 according to one embodiment. The reel arrangement 300 includes a first reel 302, a second reel 304 and a third reel 306. The reel arrangement 300 can be a randomized input to an electronic gaming machine. For example, the reel arrangement 300 can be suitable for use as the reel arrangement 212 of the electronic gaming machine 200 illustrated in FIG. 2. To provide the randomized input, the first reel 302, the second reel 304, and the third reel 306 can each be activated to perform a spinning action (either physical or virtual), with each of the first reel 302, the second reel 304 and the third reel 306 independently operating to provide an input value. That is, the first reel 302 yields a first input value, the second reel 304 yields a second input value, and the third reel 306 yields a third input value. Thus, the reels 302, 304, and 306 may each independently have a stop location based upon player input and/or randomized input received (e.g., from the RNG).

FIG. 3 also depicts a pay line 308 that denotes the set of input values being used as input values to a wager-based game provided by an electronic gaming machine. In the example shown in FIG. 3, following the activating of the first reel 302, the second reel 304 and the third reel 306, the reels respectively yield the input values "2", "4" and "2" at the reel-stop positions at the pay line 308. The reel arrangement 300 illustrates only a single pay line 308; however, in other embodiments multiple pay lines can be utilized (see, e.g., FIG. 7).

Figure 4:
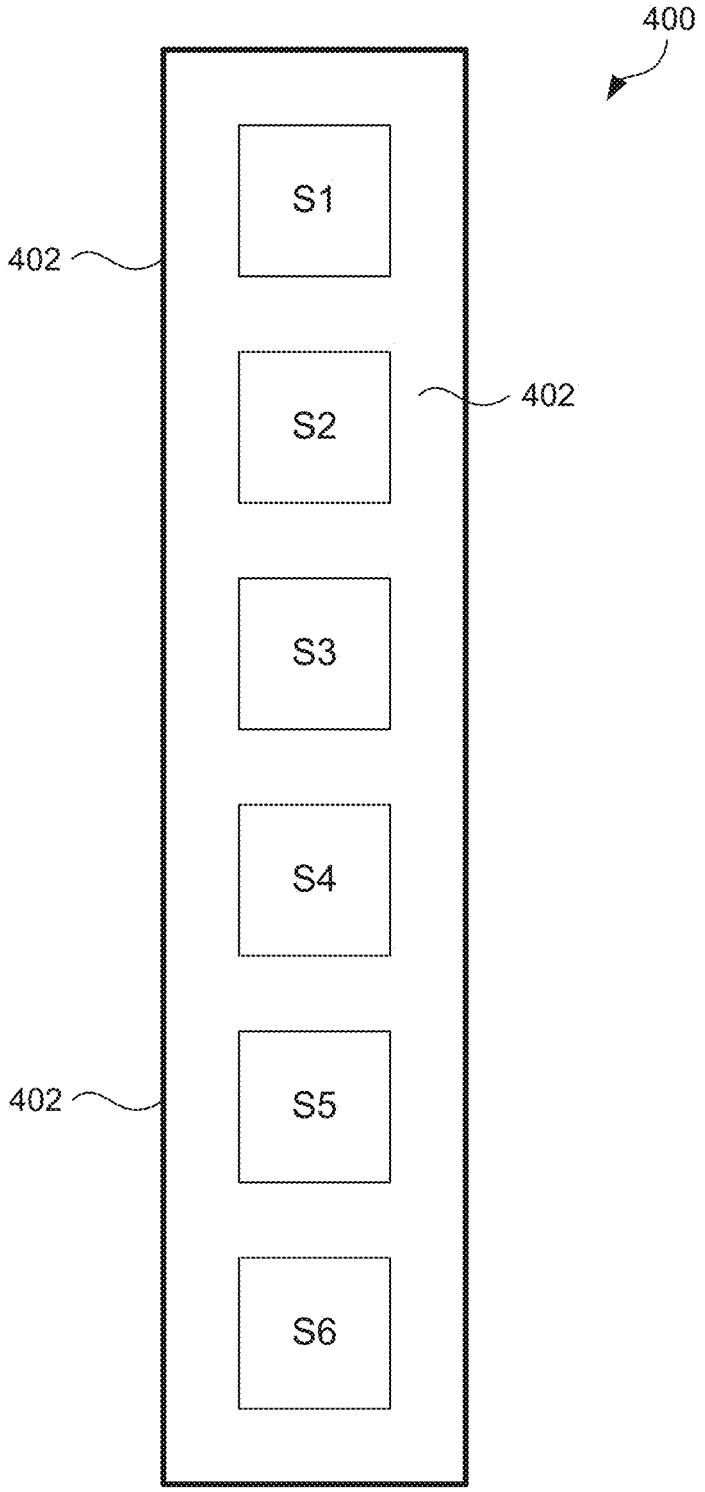
FIG. 4 is a representative layout diagram of a reel according to one embodiment.

FIG. 4 is a representative layout diagram of a reel 400 according to one embodiment. The reel 400 can be used to provide a randomized input to a wager-based game being operated on an electronic gaming machine. In this embodiment, the reel 400 has six predetermined reel-stop positions, which are denoted S1, S2, S3, S4, S5 and S6. As shown in FIG. 4, the reel-stop positions are distributed on an outer surface 402 of the reel 400. Although the reel 400 in depicted in a linear manner, in a typical embodiment, the reel 400 is circular and the reel-stop positions are distributed around the outer circumference of the reel 400. In another embodiment, such as with digital or virtual reels, the reel 400 may appear to be rotating in a circular pattern.

Figure 5A:
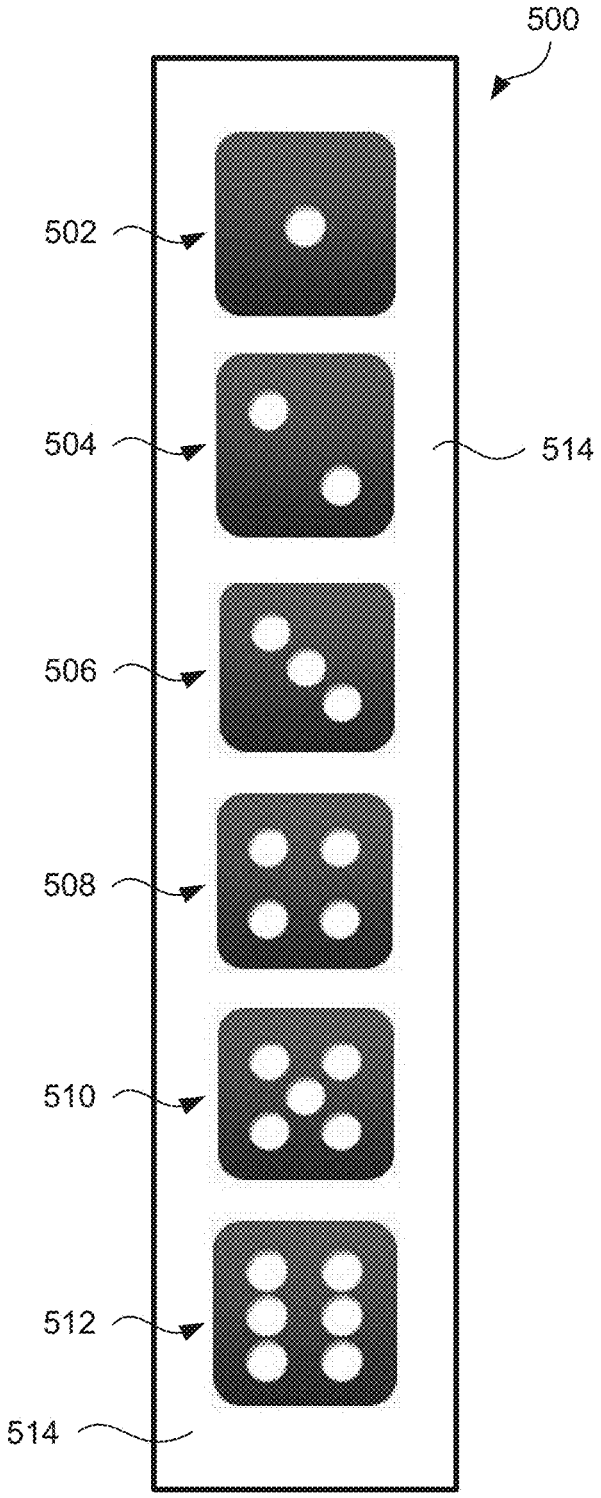
FIG. 5A is a representative layout diagram of a reel according to one embodiment.

FIG. 5A is a representative layout diagram of a reel 500 according to one embodiment. The reel 500 can be used to provide a randomized input to a wager-based game being operated on an electronic gaming machine. In this embodiment, the reel 500 has six predetermined reel-stop positions, which represent each of the different faces of a die. In this embodiment, the die faces are arranged in a numerically increasing manner. Namely, a die face for a "1" is denoted at reel-stop position 502; a die face for a "2" is denoted at reel-stop position 504; a die face for a "3" is denoted at reel-stop position 506; a die face for a "4" is denoted at reel-stop position 508; a die face for a "5" is denoted at reel-stop position 510; and a die face for a "6" is denoted at reel-stop position 512. As shown in FIG. 5A, the reel-stop positions are distributed on an outer surface 514 of the reel 500. Although the reel 500 in depicted in a linear manner, in a typical embodiment, the reel 500 is circular (physically or virtually) and the reel-stop positions are distributed around the outer circumference of the reel 500.

Figure 5B:
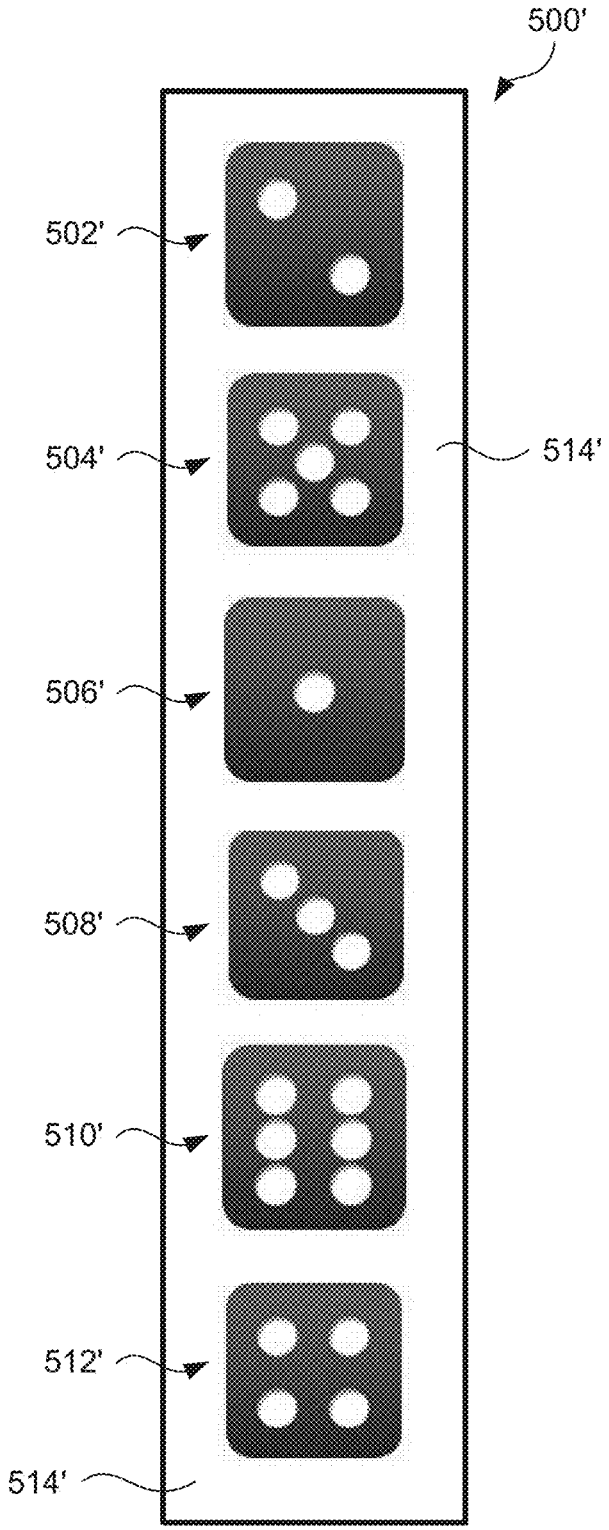
FIG. 5B is a representative layout diagram of a reel according to another embodiment.

FIG. 5B is a representative layout diagram of a reel 500' according to another embodiment. The reel 500' can be used to provide a randomized input to a wager-based game being operated on an electronic gaming machine. In this embodiment, the reel 500' has six predetermined reel-stop positions, which represent each of the different faces of a die. In this embodiment, in contrast to the embodiment shown in FIG. 5A, the die faces are arranged in a numerically scrambled or non-ordered manner. Namely, a die face for a "2" is denoted at reel-stop position 502'; a die face for a "5" is denoted at reel-stop position 504'; a die face for a "1" is denoted at reel-stop position 506'; a die face for a "3" is denoted at reel-stop position 508'; a die face for a "6" is denoted at reel-stop position 510'; and a die face for a "4" is denoted at reel-stop position 512'. As shown in FIG. 5B, the reel-stop positions are distributed on an outer surface 514' of the reel 500'. Although the reel 500' is depicted in a linear manner, in a typical embodiment, the reel 500 is circular (physically or virtually) and the reel-stop positions are distributed around the outer circumference of the reel 500'.

Figure 6A:
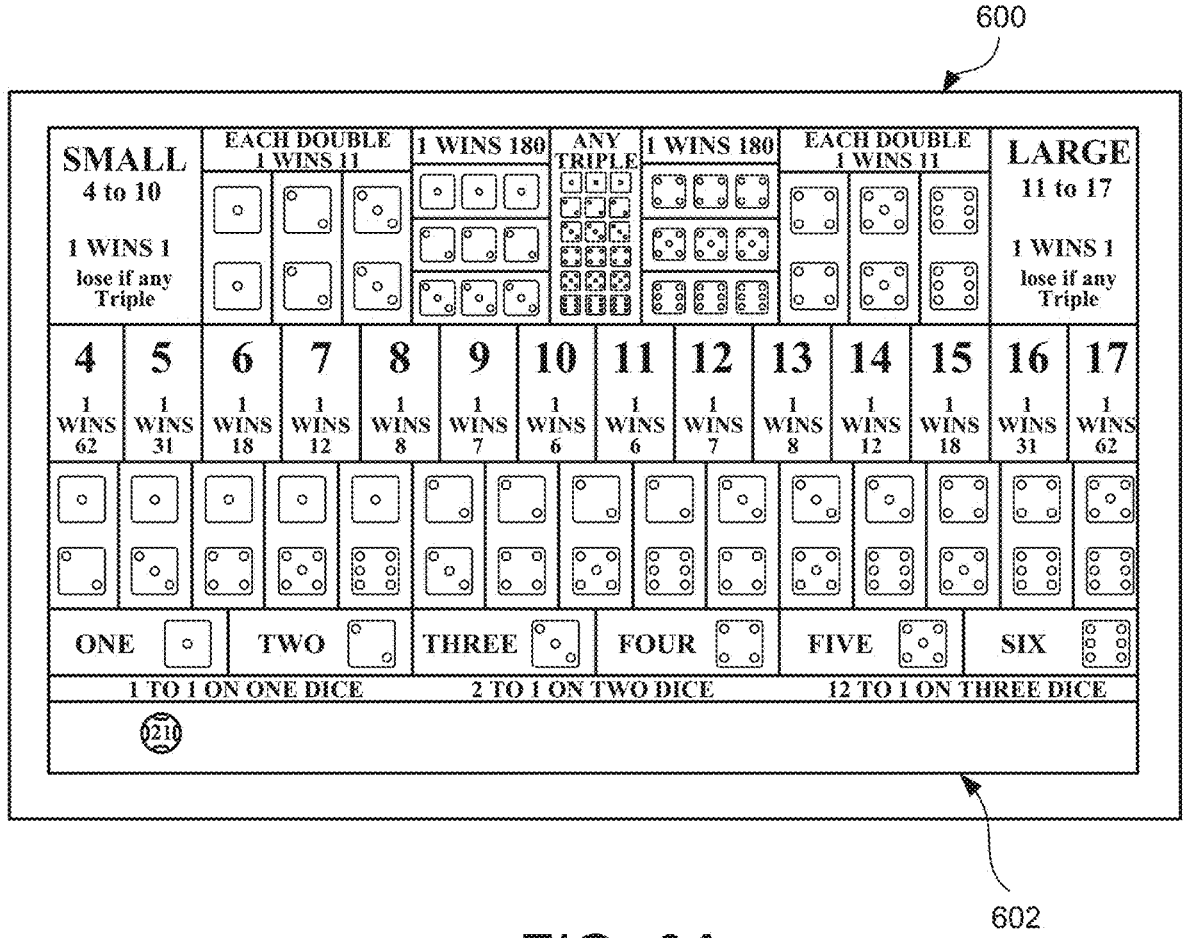
FIG. 6A is a representative diagram of a touch screen according to one embodiment.

FIG. 6A is a representative diagram of a touch screen 600 according to one embodiment. The touch screen 600 can be part of or coupled to an electronic gaming machine, such as the electronic gaming machine 100 illustrated in FIG. 1. As illustrated in FIG. 6A, the touch screen 600 can be used to display a SicBo pay table 602. The SicBo pay table 602 provides user-selectable options (e.g., bet options), each of which can include at least one winning combination and/or a corresponding winning payout. For example, a single user selection (e.g., tap of the touch screen 600) can select a winning combination for a wager as well as its corresponding winning payout, as further discussed below regarding FIG. 6B. However, any other table game themes, pay table, or information may be displayed. A user can then interact with the touch screen 600 to make one or more selections so as to make one or more bets. The touch screen 600 can be implemented by any supporting technology, such as capacitive, resistive, and the like. The touch screen 600 can serve as an electronic visual display to output information to one or more users of the electronic gaming machine. The touch screen 600 can also serve as an input device to the electronic gaming machine. For example, by touching or gesturing with the touch screen 600, by a finger or stylus, a user can provide input to the electronic gaming machine. For example, the touch screen 600 can implement the user-selectable options as touch regions, such as virtual buttons. In another embodiment, a camera and/or a microphone may detect an input from the user (e.g. via gestures, voice commands, and the like) to provide gaming input (e.g. betting amount, gaming actions such as a "hit", "stay", "double down", and any other desired betting or gaming actions).

Figure 6B:
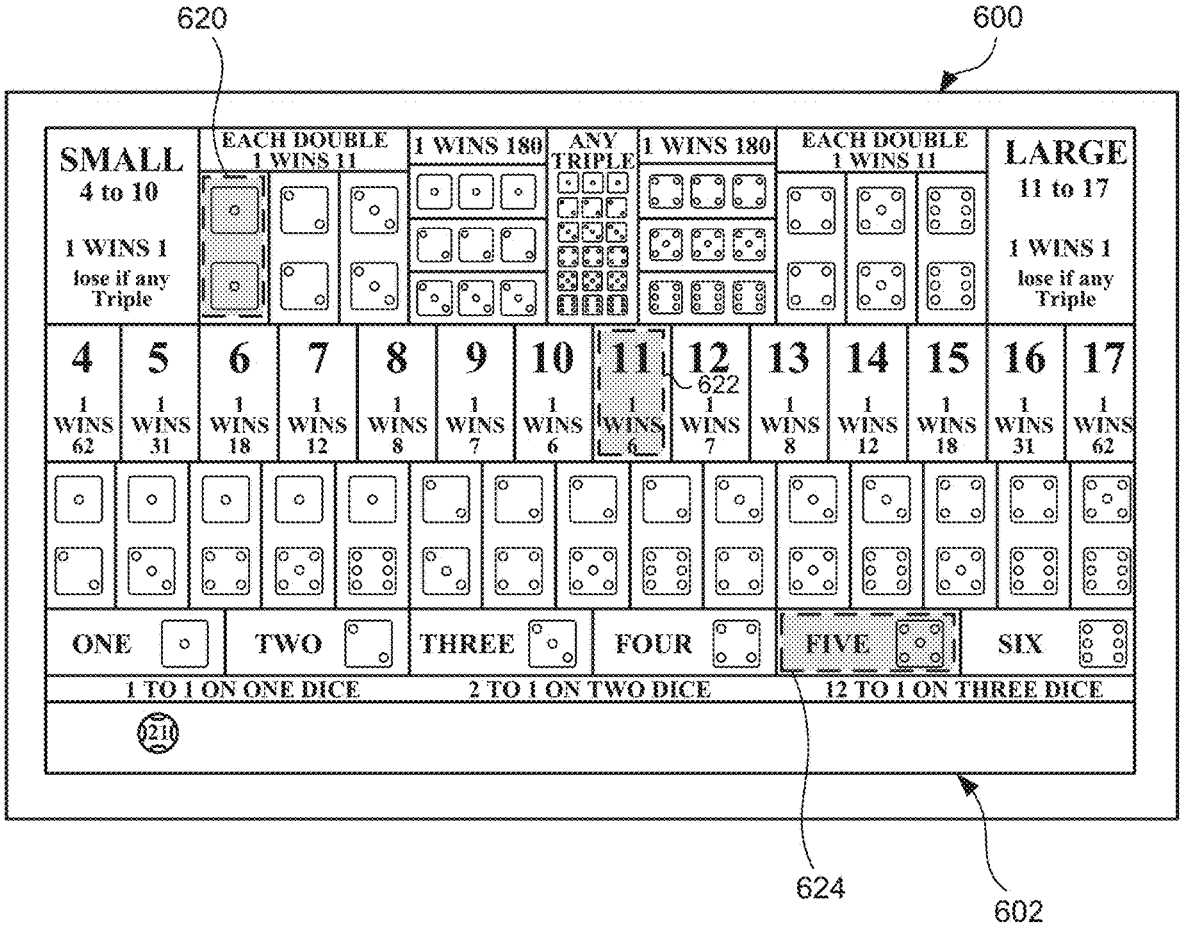
FIG. 6B is a representative diagram of user selections according to one embodiment.

FIG. 6B is a representative diagram of user selections according to one embodiment. The touch screen 600 shown in FIG. 6B is the touch screen 600 shown in FIG. 6A with multiple selections of the SicBo pay table 602 made as representative user selections. In the example shown in FIG. 6B, the user has made selections with respect to the user-selectable options such that the user is placing three concurrent bets. Namely, the user has made a first selection 620, a second selection 622 and a third selection 624. The first selection 620 shows that the user placed a bet on a pair of "1" being obtained on the die faces following a randomized input to a wager-based game being operated on the electronic gaming machine. The second selection 622 shows that the user placed a bet on a numerical total of "11" being obtained on the die faces following a randomized input to the wager-based game. The third selection 624 shows that the user placed a bet on a "5" being obtained on one or more of the die faces following a randomized input to the wager-based game. Recall, the die faces can be implemented as reel-stop positions on a reel that is either physical or virtual. The corresponding payouts are displayed with or adjacent the user-selectable options being selected by the first selection 620, second selection 622 and third selection 624 selections. The corresponding payout for the first selection 620 is "1 wins 11". The corresponding payout for the second selection 622 is "1 wins 6". The corresponding payout for the third selection 624 is "12 to 1 on three dice".

As shown in FIGS. 6A and 6B, winning combinations for a bet can be integrated with its associated payout and visually presented for a user. Further, a particular winning combination of a bet and its associated payout can both be selected with a single user action, such as a user's selection (e.g., touch or tap on a touch screen) of a user-selectable option with respect to a touch screen.

In another embodiment, the user may use gestures and/or audio input that may be received by a camera and/or microphone on the electronic gaming machine. The camera and/or microphone may receive the input that the user would like to place a bet on a pair of "1" being obtained on the die faces 620, place a bet on a numerical total of "11" being obtained on the die faces 622, and place a bet on a "5" being obtained on one or more of the die faces 624. Thus, selections 620, 622, 624 may be automatically made by the electronic gaming machine without any physical interaction with the touch screen by the user.

Figure 7:
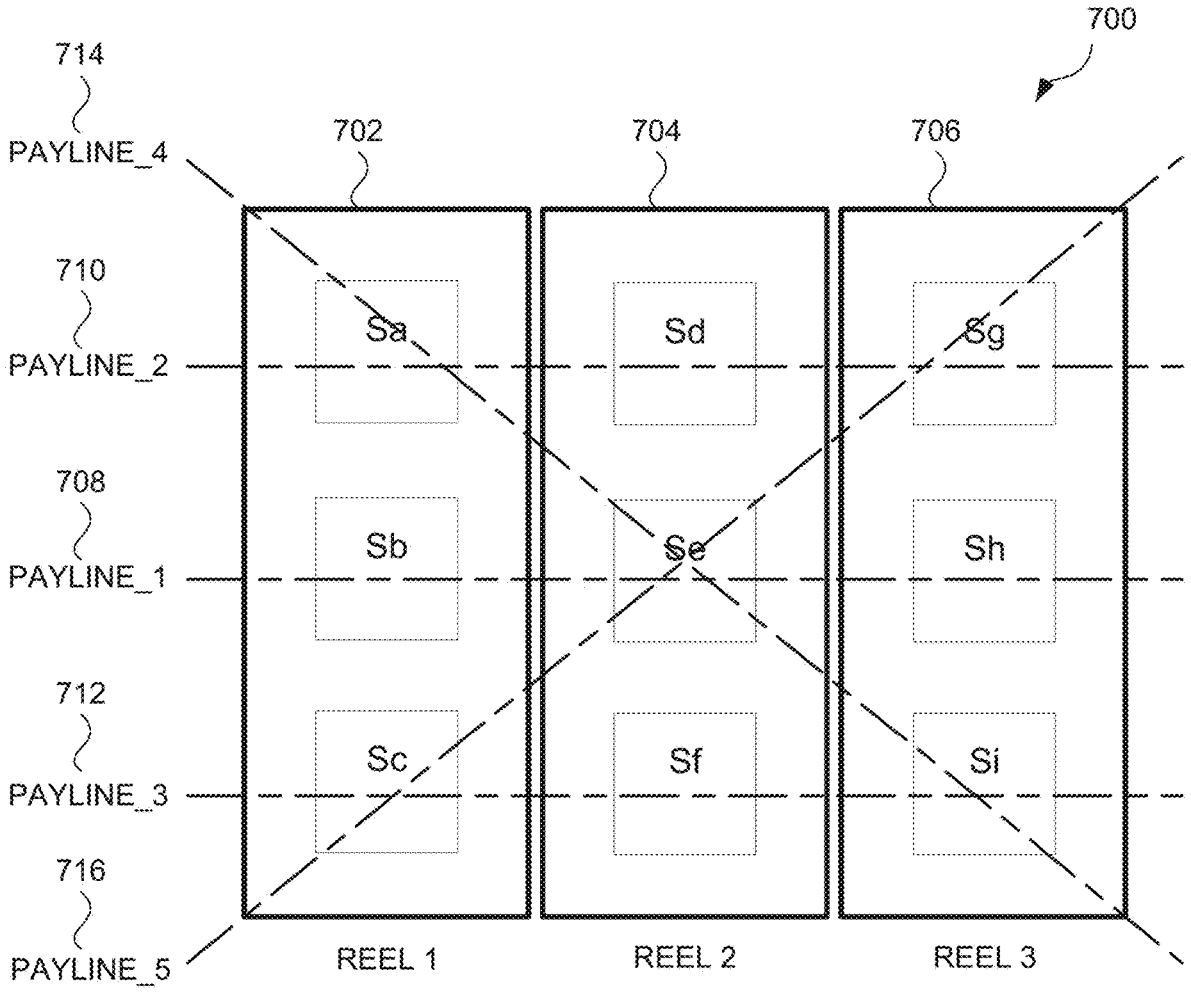
FIG. 7 is a representative diagram of a reel arrangement according to one embodiment.

FIG. 7 is a representative diagram of a reel arrangement 700 according to one embodiment. The reel arrangement 700 includes a first reel 702, a second reel 704 and a third reel 706. The reel arrangement 700 can, in one embodiment, be positioned in randomized locations. Reel arrangement 700, in one example, can be suitable for use as the reel arrangement 212 of the electronic gaming machine 200 illustrated in FIG. 2. To provide the randomized input, the first reel 702, the second reel 704 and the third reel 706 can each be activated to perform a spinning action (either physical or virtual), with each of the first reel 702, the second reel 704 and the third reel 706 independently operating and independently stopping to provide various input values depending on various pay lines used and/or selected by user.

Each of the first reel 702, the second reel 704 and the third reel 706 are configured to have various predetermined reel-stop positions, only a portion of which are shown in FIG. 7. In the exemplary embodiment shown in FIG. 7, each reel 702, 704, 706 can visually output three distinct reel-stop positions. The first reel 702 depicts adjacent reel-stop positions Sa, Sb and Sc. The second reel 704 depicts adjacent reel-stop positions Sd, Se and Sf. The third reel 706 depicts adjacent reel-stop positions Sg, Sh and Si.

The reel arrangement 700 supports five distinct pay lines. In this embodiment, the player can place a bet on any of one or more of the pay lines. For a given pay line, the first reel 702 yields a first input value, the second reel 704 yields a second input value, and the third reel 706 yields a third input value. The player selects the one or more desired play line(s) through one or more user selections. The user selection can be via a button, a touch/gesture input, audio input, or any other known methods of selection or input. The five distinct play lines shown in FIG. 7 include PLAYLINE_1 (708), PLAYLINE_2 (710), PLAYLINE_3 (712), PLAYLINE_4 (714), and PLAYLINE_5 (716). Assuming that the reel arrangement in FIG. 7 is after reel actuation and thus provides input values, then PLAYLINE_1 uses reel stop positions Sb, Se and Sh of reels 1, 2 and 3, respectively; PLAYLINE_2 uses reel stop positions Sa, Sd and Sg of reels 1, 2 and 3, respectively; PLAYLINE_3 uses reel stop positions Sc, Sf and Si of reels 1, 2 and 3, respectively; PLAYLINE_4 uses reel stop positions Sa, Se and Si of reels 1, 2 and 3, respectively; and PLAYLINE_5 uses reel stop positions Sc, Se and Sg of reels 1, 2 and 3, respectively.

However, in contrast to a traditional slot machine, the symbols that are presented at the reel stop positions are not simply evaluated to see if they are matching across one or more selected paylines, such as cherry-cherry-cherry. Instead, in table games, such as SicBo, a user selects bet options (e.g., winning combinations) that are dependent on the resulting symbols at the reel stop positions. For example, the symbols can be represented as die faces, that is, symbols having a numerical value from 1 to 6. See, e.g., FIG. 5A. As shown in FIG. 6B, through user selections, a player can select one or more bet option, such as by selecting desired winning combinations of symbols (e.g., numeric values including numeric combinations) that are relevant for a given wager (or bet). Then, the randomized gaming results are achieved and evaluated relative to the selected symbols for the given wager. In one embodiment, the player selects one or more bet options to identify a unique, unordered group of specified symbols that are associated with a particular wager. Further, with traditional slot machines, a player selects one or more paylines to bet on, whereas with in table games, such as SicBo, the play selects a volatility for a bet (e.g., higher volatility yields greater payout).

If the unique, unordered group of specified symbols are the resulting symbols at the reel stop positions, the corresponding winning payout may be determined. In one embodiment, the corresponding winning payout may be based on the given wager. For example, higher given wagers can yield higher corresponding winning payouts. In some embodiments, the winning payout for a player may be independent of the geometric shapes of resulting symbols at predetermined paylines. For example, as illustrated in FIG. 6B, the first selection 620 is based on a double being achieved at the reel stop positions. In one implementation, the double for a player win is confined to a payline, such as one or more of the paylines shown in FIG. 7. In another implementation, the double for a player win can be in any of the paylines, such as anywhere in the first reel 702, second reel 704 or third reel 706. For example, for the another implementation, if a "1" results at reel stop position Sa and another "1" results at reel stop position Sh, the player can be deemed a winner. Thus, the player's bet options need not be dependent on spatial position or arrangement of symbols displayed on display 700.

Figure 8:
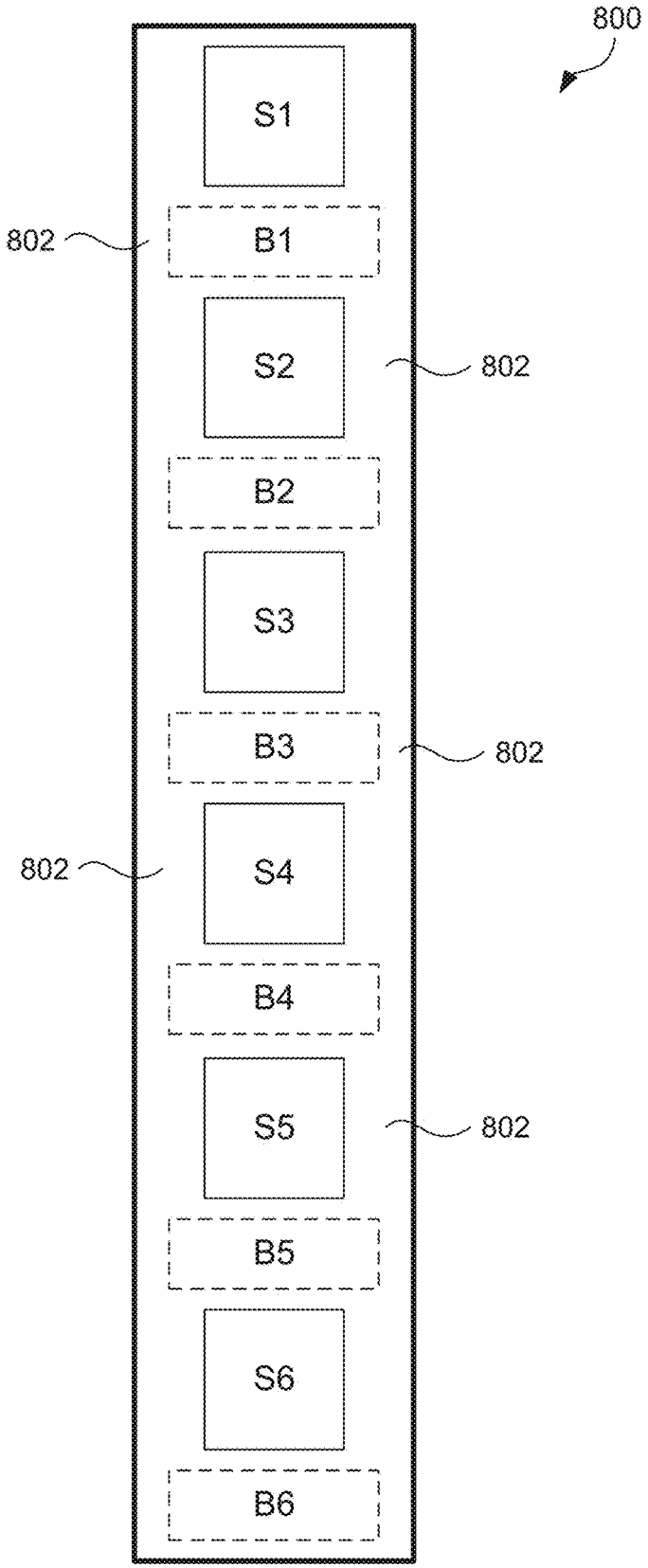
FIG. 8 is a representative layout diagram of a reel according to one embodiment.

FIG. 8 is a representative layout diagram of a reel 800 according to one embodiment. The reel 800 can be used to provide a randomized input to a wager-based game being operated on an electronic gaming machine, such as electronic gaming machine 100 illustrated in FIG. 1. The reel 800 has a layout that is configured to include additional blank or offset reel-stop positions as compared to the reel shown in FIG. 4. In one embodiment, the reel 800 can be configured for use with a bonus game (e.g., a bonus wager-based game or a bonus chance-based game), whereas the reel 400 can be configured for use with a primary wager-based game. The addition of one or more of the blank or offset reel-stop positions to the reel 800 can be used to control probabilities of a "win" of a bonus game. As shown in FIG. 8, the reel-stop positions are distributed on an outer surface 802 of the reel 800. Although the reel 800 is depicted in a linear manner, in a typical embodiment, the reel 800 is circular, or has an appearance of being circular, and the reel-stop positions are distributed around the outer circumference of the reel 800.

In the representative embodiment shown in FIG. 8, the reel 800 has twelve predetermined reel-stop positions, which are denoted S1, S2, S3, S4, S5 and S6 and B1, B2, B3, B4, B5 and B6. In one implementation, the reel-stop positions S1, S2, S3, S4, S5 and S6 can be referred to as primary stop positions and contain a die face designation, and the reel-stop positions B1, B2, B3, B4, B5 and B6 can be referred to as blank stop positions that contain no die face designation (or which contain an offset die designation). For example, the reel-stop positions S1, S2, S3, S4, S5 and S6 can reference die faces "1", "2", "3", "4", "5" and "6", respectively, or in any scrambled order. In the same implementation, the reel-stop positions B1, B2, B3, B4, B5 and B6 can be aligned with a blank or offset die face such that the result of a reel activation (e.g., spin) is a miss, that is, none of the die faces are chosen.

In an embodiment in which the reels are implemented as electro-mechanical reels, there can be one or more reels. In an implementation in which there are three (3) reels, a first reel of the electro-mechanical reels can use a first number of reel-stop positions, a second reel of the electro-mechanical reels can have a second number of reel-stop positions, and a third reel of the electro-mechanical reels can have a third number of reel-stop positions. Also, the number of reel stop positions can be the same or different for the different reels. In other words, the first number of reel-stop positions, the second number of reel-stop positions, and the third number of reel-stop positions can be the same or different. In another embodiment, the reels can be implements in a virtual or computerized manner and in such case the number of reel-stop positions can be controlled/configured through programming or settings to be the same or different for the different reels. Still further, for a bonus game operation, the one or more reels can be configured or operated differently than for a primary game operation. For example, the one or more reels, for a bonus game operation, might use a greater number of reel-stop positions than are used during the primary game operation. Alternatively, the reel-stop positions for a bonus game operation can be weighted differently as compared to those for a primary game operation, which can alter probabilities of different ones of the reel-stops. In other words, each reel-stop may be assigned with different probabilities of stopping at that reel-stop. This can, for example, be done by mapping different range of numbers, generated by a RNG, to a reel-stop position. For example, the RNG is programmed to generate a number between 1 and 100 for each reel spin, and the numbers 1-30 can be mapped to reel stop position B1, and the numbers 90-100 can be mapped to the reel stop position B5. The probability of stopping at reel-stop B1 would then be 3 times greater than the probability of stopping at reel-stop B5. Thus, the reel 800 may stop more frequently at reel-stop B1 than at B5. With respect to use of virtual reels, there is greater control and flexibility for designing different number of reel stop positions, symbols and/or symbol layouts. In any case, by assigning different probabilities, winning payouts may be altered for primary and bonus games.

Figure 9:
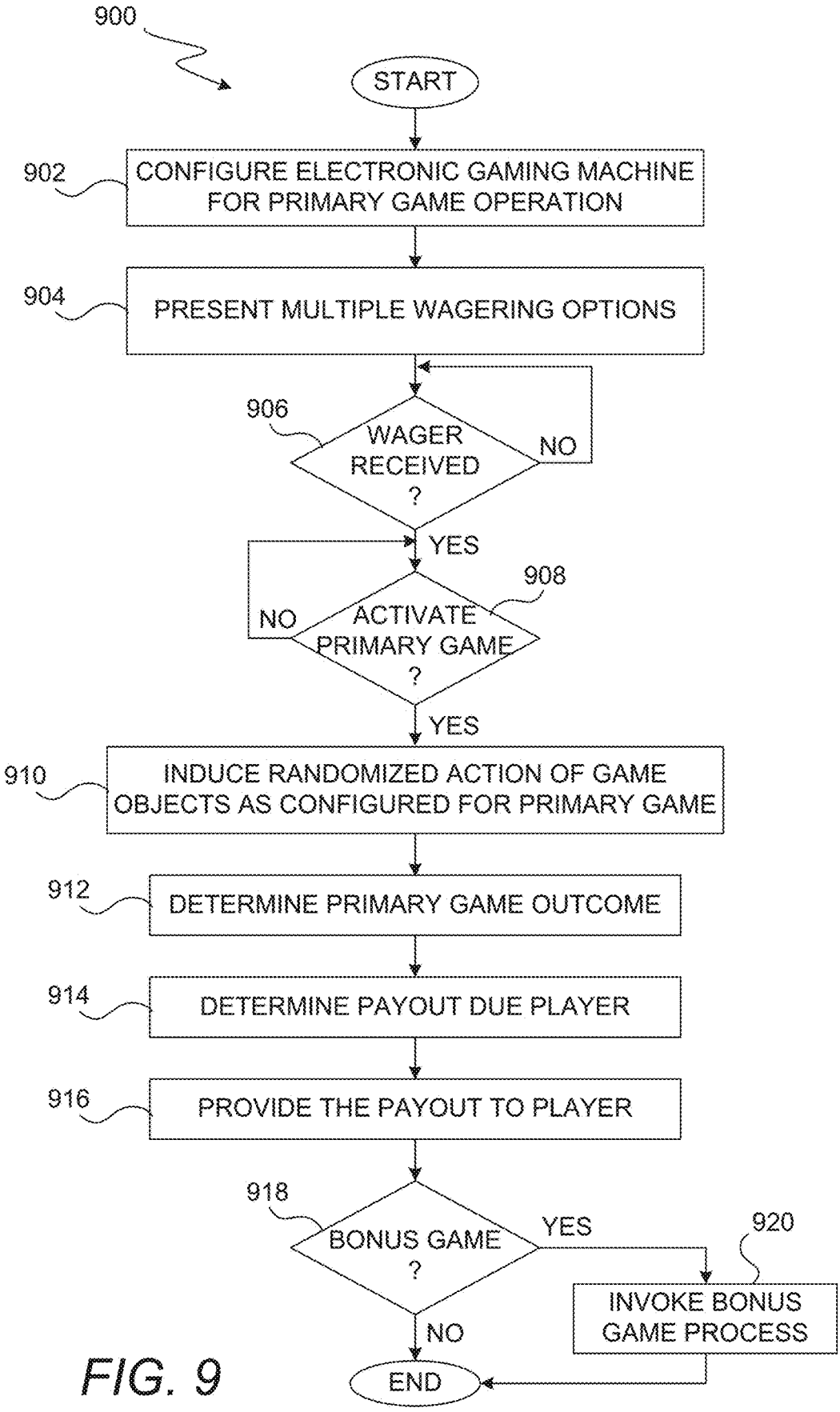
FIG. 9 is a flow diagram of a primary game process according to one embodiment.

FIG. 9 is a flow diagram of a primary game process 900 according to one embodiment. The primary game process 900 is, for example, performed by an electronic gaming machine, such as the electronic gaming machine 100 illustrated in FIG. 1. The electronic gaming machine 100 can also be coupled to a network, wirelessly or wired, and a remote server (e.g., gaming server) can couple to the network to assist the electronic gaming machine 100 in performing, managing or regulating wager-based games performed by the primary game process 900. As discussed above and below, the electronic gaming machine can support not only a primary wager-based game but also a bonus game, often a bonus chance-based game or a bonus wager-based game.

The primary game process 900 can configure 902 the electronic gaming machine for primary game operation. The configuration 902 of the electronic gaming machine for the primary game operation can, for example, configure the electronic gaming machine to provide randomized input to the primary wager-based game being operated on the electronic gaming machine. In one implementation, the randomized input is provided by one or more game objects. As an example, the one or more game objects can be one or more reels. In one specific implementation, the configuration 902 can utilize one or more reels that are configured to provide the randomized input to the primary wager-based game. In such case, the configuration 902 can set reel-stops for one or more reels in accordance with the primary game operation. In one example, the one or more reels can be configured to mimic die spins, tosses, or any other function such as the reel layouts shown in FIG. 4.

Next, multiple wagering options can be presented 904. The multiple wagering options are presented 904 to enable a user of the electronic gaming device to place one or more wagers with respect to the primary wager-based game. In one embodiment, the multiple wagering options can be presented as a play table on a touch screen, such as shown in FIG. 6A. After the wagering options are presented 904, the primary game process 900 can determine 906 whether a wager has been received. If it is determined 906 that a wager has not yet been made, then the primary game process 900 can await such a wager.

Once the primary game process 900 determines 906 that a wager has been received, a decision 908 can determine whether the primary game should be activated. When the decision 908 determines that the primary game is not to be activated, then the primary game process 900 can wait until the primary game is to be activated.

Once the decision determines 908 that the primary game is to be activated, then the primary game process 900 continues. A randomized action can then be induced 910 on one or more game objects. The randomized action being induced 910 can pertain to a spinning, tossing, dealing, or otherwise moving one or more game objects, as discussed above, to provide a random result from the one or more game objects. As noted above, the one or more game objects can pertain to one or more reels having reel-stop positions that provide input to the primary wager-based game. These one or more game objects can be configured for the primary game when the electronic gaming machine is configured 902. The one or more game objects are used with the primary wager-based game. Following the inducement 910 of the randomized action, the one or more game objects settle (e.g., stop spinning or moving) and yield an input to the primary wager-based game of chance. In one embodiment, the game objects settle after a predetermined period of time. In another embodiment, the game objects settle after receiving an input from the player via the input buttons (or other input) via the electronic gaming machine.

Next, the primary game process 900 can determine 912 a primary game outcome. A payout due to the player of the primary wager-based game, if there was a win, can also be determined 914. The payout due to the player may be dependent on one or more criteria. For example, the payout may be based on the one or more wagers the player placed, the number of pay lines selected, payout table, the primary game outcome, and any other similar criteria. Thereafter, the payout can be provided 916 to the player.

Next, a decision 918 can determine if a bonus game is to be provided. When the decision 918 determines that a bonus game is to be provided, the primary game process can invoke 920 a bonus game process. The bonus game process 920 can permit the player of the primary wager-based game to play a bonus game, which can also be wager-based or chance-based. Alternatively, when the decision 918 determines that a bonus game is not to be provided or after conclusion of the bonus game if invoked 920, then the primary game process 900 can end as the primary wager-based game as well as any bonus game have concluded.

Figure 10:
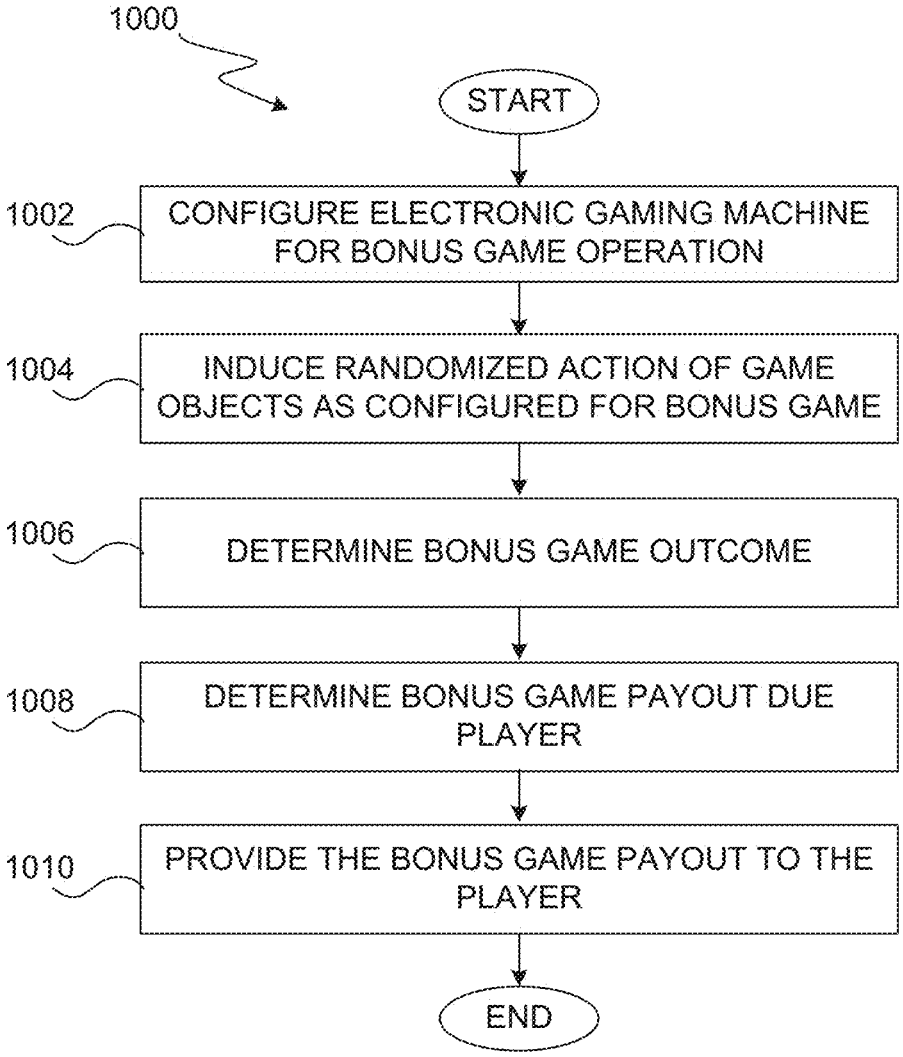
FIG. 10 is a flow diagram of a bonus game process according to one embodiment.

FIG. 10 is a flow diagram of a bonus game process 1000 according to one embodiment. The bonus game process 1000 can configure 1002 the electronic gaming machine for bonus game operation. The configuration 1002 of the electronic gaming machine for the bonus game operation can, for example, configure the electronic gaming machine to provide randomized input to the bonus game being operated on the electronic gaming machine. In one implementation, the randomized input is provided by one or more game objects. As an example, the one or more game objects can be one or more reels. In one specific implementation, the configuration 1002 can utilize one or more reels that are configured to provide the randomized input to the primary wager-based game. In such case, the configuration 1002 can set reel-stops for one or more reels in accordance with the bonus game operation. In one example, the one or more reels can be configured to mimic die spins/tosses, such as the reel layouts shown in FIG. 8.

After the configuration 1002 of the electronic gaming machine for the bonus game operation, a randomized action can then be induced 1004 on one or more game objects. The randomized action being induced 1004 can pertain to a spinning, tossing, dealing, or otherwise moving the one or more game objects to provide a random result from the one or more game objects. As noted above, the one or more game objects can pertain to one or more reels having reel-stop positions that provide input to the bonus game. These one or more game objects can be configured for the bonus game when the electronic gaming machine is configured 1002. The one or more game objects are used with the bonus game, which may be the same or different one or more game objects used with the primary wager-based game. Following the inducement 1004 of the randomized action, the one or more game objects settle (e.g., stop spinning or moving) and yield an input to the bonus game.

Next, the bonus game process 1000 can determine 1006 a bonus game outcome. A bonus payout due the player of the bonus game can also be determined at 1008. The bonus payout due the player can be dependent on the bonus game outcome. Thereafter, the bonus payout can be provided 1010 to the player. After the bonus payout is provided 1010, the bonus game process 1000 can end and processing can optionally return to the primary wager-based game for any subsequent processing.

Figure 11:
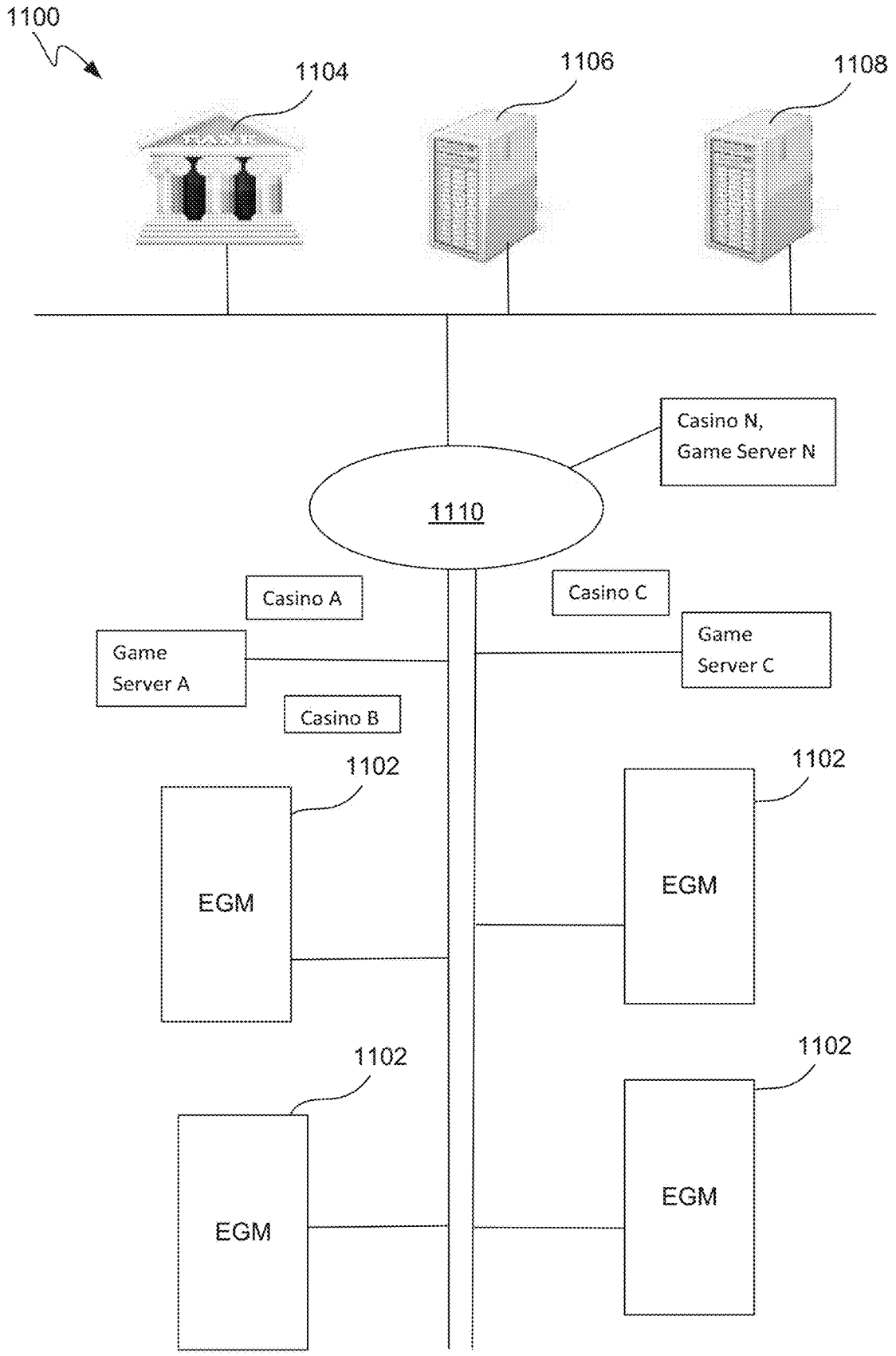
FIG. 11 is an exemplary block diagram of a wide area interactive table gaming machine system according to one embodiment.

FIG. 11 is an exemplary block diagram of a wide area interactive table gaming machine system 1100 according to one embodiment. The gaming machine system 1100 can utilize multiple electronic gaming machines (EGMs) 1102, one or more remote system servers, and various other system components across one or multiple locations. The gaming machine system 1100 can include a wide variety of components and items, such as a bank 1104, a games router 1106, and a financial clearinghouse 1108, among other items. A network 1110 can couple these items to the EGMs 1102, terminals, game servers, casinos, and other distributed components, as may be desired. Various networked casinos, game servers, EGMs 1102 and other remote terminals can also be coupled through the network 1110 in the gaming machine system 1100. The network 1110 can be of wired (Ethernet, Token Ring, Serial multidrop, ATM, etc.) or wireless variety (802.11x, BlueTooth, LTE, 2G/3G/4G cellular, Zigbee, Ultra Wide Band, etc.) known in the art, as may be suitable or desired.

One or more game servers may be present in the gaming machine system 1100, and each may operate in a particular manner to facilitate the play of the various networked EGMs 1102 set forth above. In such embodiments, a game server can collect live game information from each of the self-contained EGM 1102, apply game rules, determine game results, determine winning amounts, and any other gaming operation information and/or data. Besides monitoring and controlling the games, the game server can also keep track, such as in a database, the game history of each of the EGMs 1102 and its associated physical components, accounting information, revenue reports, bonuses and bonusing progress, mystery jackpots, maintenance information, and the like. Each of these individual functions can be performed by a separate application on a separate server, or integrated into one application running on one comprehensive server. The determination of one or multiple servers and applications depends on the number of EGMs, game stations, casinos, and other associated devices, both local and remote, that are being connected across the gaming machine system 1100. For example, a specialized system server or processor can be dedicated to tracking playing card IDs and locations.

Additional functions of the servers in the gaming machine system 1100 can include game resolution at various EGMs 1102, the handling of financial transactions from EGMs 1102 and/or remote game terminals, the push of live game information to a game server to be broadcast to other EGMs 1102 and other remote gaming terminals, matchmaking between various system devices and stations, providing communications between system components, and other pertinent gaming system functions. Details regarding these and other gaming system functions can be found at, for example, U.S. Pat. Nos. 8,808,077; 8,684,830; and 8,821,239 each of which are incorporated by reference herein for such purposes, and also U.S. patent application Ser. Nos. 13/893,340; and 13/844,617, each of which are incorporated by reference herein for such purposes.

Those skilled in the art will readily appreciate that any of the systems and methods of the disclosure may include various computer and network related software and hardware, such as programs, operating systems, memory storage devices, data input/output devices, data processors, servers with links to data communication systems, wireless or otherwise, and data transceiver terminals, and may be a standalone device or incorporated in another platform, such as an existing electronic gaming machine, portable computing device or electronic platforms with multiple player positions. Those skilled in the art will further appreciate that the precise types of software and hardware used are not vital to the full implementation of the methods of the disclosure so long as players and operators thereof are provided with useful access thereto or the opportunity to play the game as described herein.

The various aspects, features, embodiments or implementations of the invention described above can be used alone or in various combinations.

Embodiments of the invention can, for example, be implemented by software, hardware, or a combination of hardware and software. Embodiments of the invention can also be embodied as computer readable code on a computer readable medium. In one embodiment, the computer readable medium is non-transitory. The computer readable medium is any data storage device that can store data which can thereafter be read by a computer system. Examples of the computer readable medium generally include read-only memory and random-access memory. More specific examples of computer readable medium are tangible and include Flash memory, EEPROM memory, memory card, CD-ROM, DVD, hard drive, magnetic tape, and optical data storage device. The computer readable medium can also be distributed over network-coupled computer systems so that the computer readable code is stored and executed in a distributed fashion.

Numerous specific details are set forth in order to provide a thorough understanding of the present invention. However, it will become obvious to those skilled in the art that the invention may be practiced without these specific details. The description and representation herein are the common meanings used by those experienced or skilled in the art to most effectively convey the substance of their work to others skilled in the art. In other instances, well-known methods, procedures, components, and circuitry have not been described in detail to avoid unnecessarily obscuring aspects of the present invention.

In the foregoing description, reference to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. An electronic gaming machine, comprising:

a processor configured to execute a plurality of instructions to provide a wager-based primary game for a player of the wager-based primary game at the electronic gaming machine;

a data storage device operatively connected to the processor, the data storage device storing the plurality of instructions, and the plurality of instructions including at least:

computer program instructions for configuring the electronic gaming machine to provide primary game operation for the wager-based primary game;

computer program instructions for receiving a player input pertaining to a plurality of player-selectable bet options, each of the plurality of player-selectable bet options associated with one of a plurality of distinct bet options, wherein the player can concurrently select multiple player-selectable bet options for the wager-based primary game;

computer program instructions for initiating randomized action of game objects as configured for the primary game operation for the wager-based primary game;

computer program instructions for determining a primary game outcome for the wager-based primary game based on the determined outcome of the game objects and ceasing the randomized action of the game objects based on the primary game outcome; and computer program instructions for determining primary game payout for the player of the wager-based primary game; and a touch screen operatively connected to the processor, the touch screen being configured to display a plurality of player-selectable bet options and configured to receive one or more selections of the plurality of player-selectable bet options, the touch screen having a first portion displaying a first set of the plurality of player-selectable bet options each of which represent a pair of die having common die values, a second portion displaying a second set of the plurality of player-selectable bet options each of which represent a pair of die having different die values, and a third portion displaying a third set of the plurality of player-selectable bet options each of which represent a single die, wherein each of the plurality of the plurality of player-selectable bet options pertains to a predetermined winning combination and a predetermined corresponding payout, and wherein the electronic gaming machine has a bonus game operation, and wherein during the bonus game operation at least one of the at least one of the electro-mechanical reels uses a greater number of reel-stop positions that are used during the primary game operation.

2. The electronic gaming machine as recited in claim 1, wherein the wager-based primary game includes game rules that are the same as game rules used with a table game involving like game objects.

3. The electronic gaming machine as recited in claim 1, wherein the electronic gaming machine includes at least one electro-mechanical reel, and wherein the randomized action of game objects is achieved in part using the at least one electro-mechanical reel.

4. The electronic gaming machine as recited in claim 1, wherein the electronic gaming machine is a single player gaming terminal.

5. The electronic gaming machine as recited in claim 4, wherein the specified winning combination is based on numeric values.

6. The electronic gaming machine as recited in claim 1, wherein the one or more selections of the player-selectable bet options are used by the player to make multiple concurrent bets on the wager-based primary game.

7. The electronic gaming machine as recited in claim 6, wherein the wager-based primary game includes game rules that are the same as game rules used with a table game involving like game objects.

8. The electronic gaming machine as recited in claim 1, wherein the electronic gaming machine is a dedicated gaming terminal having a housing, wherein the processor and the data storage device are provided within the housing, and wherein housing of the electronic gaming machine supports only game play by a single player resident at the electronic gaming machine.

9. An electronic gaming machine, comprising:

a processor configured to execute a plurality of instructions to provide a wager-based primary game for a player of the wager-based primary game at the electronic gaming machine;

a plurality of electro-mechanical reels, each of the electro-mechanical reels having a plurality of reel-stop positions, the electro-mechanical reels being configured to rotate with rotation of the electro-mechanical reels being controlled based on the processor;

a data storage device operatively connected to the processor, the data storage device storing the plurality of instructions, and the plurality of instructions including at least:

computer program instructions for configuring the electronic gaming machine to provide primary game operation for the wager-based primary game;

computer program instructions for receiving a plurality of player inputs pertaining to one of a plurality of user-selectable bet options, wherein each of the plurality of user-selectable bet options are used by the player to make multiple different concurrent bets on the wager-based primary game;

computer program instructions for initiating randomized action of game objects as configured for the primary game operation for the wager-based primary game, the game objects are symbols provided on the reel stop positions, and the randomized action of the game objects comprises spinning the electro-mechanical reels;

computer program instructions for determining the primary game outcome for the wager-based primary game and ceasing the randomized action of the game objects based on the primary game outcome, the ceasing of the randomized action of the game objects comprises stopping the spinning of the electro-mechanical reels at the reel stop positions corresponding to the primary game outcome; and computer program instructions for determining primary game payout for the player of the wager-based primary game based on the received user-selectable bet options, a display having a touch screen operatively connected to the processor, the display configured to display the plurality of user-selectable bet options and the touch screen configured to receive one or more selections of the user-selectable bet options, the touch screen having: a first portion displaying a first set of the plurality of player-selectable bet options each of which represent a pair of die having common die values, a second portion displaying a second set of the plurality of player-selectable bet options each of which represent a pair of die having different die values, and a third portion displaying a third set of the plurality of player-selectable bet options each of which represent a single die, wherein the electronic gaming machine has a bonus game operation, and wherein during the bonus game operation at least one of the electro-mechanical reels uses a different number of reel-stop positions that are used during the primary game operation.

10. The electronic gaming machine as recited in claim 9, wherein the plurality of player-selectable bet options are selected via the touch screen, and wherein the player-selectable bet options denote a bet combination and a corresponding payout therefor.

11. The electronic gaming machine as recited in claim 9, wherein the selected bet option is selected via a single touch of the touch screen.

12. The electronic gaming machine as recited in claim 9, wherein, for each of the user-selectable bet options, the touch screen concurrently and adjacently displays (i) a winning combination, and (ii) a payout corresponding to the winning combination therefor.

13. The electronic gaming machine as recited in claim 9, wherein the user-selectable bet options comprise a plurality of distinct bet options, and wherein the one or more selections of the user-selectable bet options are used by the play to make multiple concurrent bets on the wager-based primary game.

14. The electronic gaming machine as recited in claim 13, wherein the wager-based primary game includes game rules that are the same as game rules used with a table game involving like game objects.

15. The electronic gaming machine as recited in claim 9, wherein a first reel of the electro-mechanical reels has a first number of reel-stop positions, and wherein a second reel of the electro-mechanical reels has a second number of reel-stop positions, and wherein the second number of reel-stop positions is different than the first number of reel-stop positions.

16. The electronic gaming machine as recited in claim 9, wherein the electronic gaming machine is a single player gaming terminal.

17. The electronic gaming machine as recited in claim 9, wherein the wager-based primary game includes game rules that are the same as game rules used with a table game involving like game objects.

18. The electronic gaming machine as recited in claim 9, wherein the wager-based primary game is SicBo.

19. The electronic gaming machine as recited in claim 9, wherein the electronic gaming machine is a dedicated gaming terminal having a housing, wherein the processor, the data storage device and the electro-mechanical reels are provided within the housing, and wherein the housing comprises:

a reel stop window that exposes to the player at least the symbols provided on the reel stop positions corresponding to the primary game outcome; and the touch screens.

20. The electronic gaming machine as recited in claim 19, wherein housing of the electronic gaming machine supports only game play by a single player resident at the electronic gaming machine.

21. The electronic gaming machine as recited in claim 20, wherein the wager-based primary game includes game rules that are the same as game rules used with a table game involving like game objects.

22. The electronic gaming machine as recited in claim 21, wherein the wager-based primary game is SicBo.

23. The electronic gaming machine as recited in claim 9, wherein during the bonus mode of operation at least one of the electro-mechanical reels uses a greater number of reel-stop positions than are used during the primary game operation.

24. The electronic gaming machine as recited in claim 9, wherein during the bonus game operation at least one of the electro-mechanical reels uses a smaller number of reel-stop positions that are used during the primary game operation.

25. A wager-based gaming machine, comprising:

a wage acceptor configured to receive a wager to play a wager-based game;

a plurality of input components configured to accept user input from a player regarding play of the wager-based game, the wager-based game including game rules that at least partially replicate a table wager game that uses at least one die;

a display configured to present multiple wagering options selectable by the player, wherein each wagering option replicates wagering options that at least partially replicate wagering options from the table wager game, each wagering option representing a pair of die having common die values, a pair of die having different die values, or a single value die, wherein each wagering option includes a monetary award based on monetary award rules that at least partially replicate monetary award rules from the table wager game, and wherein the player can concurrently select multiple wagering options for the wager-based game;

a plurality of gaming reels, at least one of the plurality of gaming reels configured to represent at least one die, wherein each face of the at least die is displayed on an outer surface of the at least one of the plurality of gaming reels, and each of the plurality of gaming reels having multiple reel stops; and a processor coupled to the one or more input components, the display, and the gaming reels, the processor adapted to facilitate the play of the wager-based game, wherein the wager-based game includes a main game phase and a bonus game phase, wherein the gaming reels are configured or operate to provide reel stop probabilities for the corresponding reel stops, wherein during the bonus game phase at least one of the gaming reels uses a different number of reel-stop positions than are used during the main game phase.

26. The wager-based gaming machine as recited in claim 25, wherein a first reel of the electro-mechanical reels has a first number of reel-stop positions, and wherein a second reel of the electro-mechanical reels has a second number of reel-stop positions, and wherein the second number of reel-stop positions is different than the first number of reel-stop positions.

27. The wager-based gaming machine as recited in claim 25, wherein the wager-based gaming machine is a single player gaming terminal.

28. The wager-based gaming machine as recited in claim 25, wherein the wager-based game includes game rules that are the same as game rules used with a table game involving like game objects.

29. The wager-based gaming machine as recited in claim 25, wherein the wager-based game is SicBo.

* * * * *